US005945241A

United States Patent [19]

Niino et al.

[11] Patent Number: 5,945,241

[45] Date of Patent: Aug. 31, 1999

[54] LIGHT RECEIVING MEMBER FOR ELECTROPHOTOGRAPHY AND FABRICATION PROCESS THEREOF

[75] Inventors: Hiroaki Niino, Nara; Satoshi Kojima; Shinji Tsuchida, both of Kyotanabe, all of Japan

[73] Assignee: Canon Kabushiki Kaisha, Tokyo, Japan

[21] Appl. No.: 08/919,347

[22] Filed: Aug. 28, 1997

[30] Foreign Application Priority Data

Aug. 29, 1996 [JP] Japan ..... 8-228409

[51] Int. Cl.[6] ..... G03G 5/043

[52] U.S. Cl. ..... 430/57; 430/133

[58] Field of Search ..... 430/57, 58, 65, 430/133

[56] References Cited

U.S. PATENT DOCUMENTS

| | | | |
|---|---|---|---|
| 4,265,991 | 5/1981 | Hirai et al. | 430/64 |
| 4,788,120 | 11/1988 | Shiral et al. | 430/66 |
| 4,932,859 | 6/1990 | Yagi et al. | 430/57 |
| 5,382,487 | 1/1995 | Fukuda et al. | 430/57 |
| 5,656,404 | 8/1997 | Niino et al. | 430/57 |
| 5,738,963 | 4/1998 | Niino | 430/57 |

FOREIGN PATENT DOCUMENTS

| | | |
|---|---|---|
| 58-21257 | 2/1983 | Japan . |
| 59-143379 | 8/1984 | Japan . |
| 60-95551 | 5/1985 | Japan . |
| 60-168156 | 8/1985 | Japan . |
| 60-178457 | 9/1985 | Japan . |
| 60-225854 | 11/1985 | Japan . |
| 61-201481 | 9/1986 | Japan . |
| 61-231561 | 10/1986 | Japan . |
| 62-83470 | 4/1987 | Japan . |
| 57-115556 | 7/1992 | Japan . |

*Primary Examiner*—John Goodrow

*Attorney, Agent, or Firm*—Fitzpatrick, Cella, Harper & Scinto

[57] ABSTRACT

For providing a light receiving member for electrophotography improved in chargeability, temperature characteristic of sensitivity, and optical memory characteristic and presenting excellent quality of image, the light receiving member for electrophotography comprises an electrically conductive substrate and a photoconductive layer of a non-monocrystal material containing hydrogen atoms in the matrix of silicon atoms, wherein the photoconductive layer has regions formed under such conditions as to obtain a first layer region and a second layer region both having characteristic energy (Eu) of not more than 55 meV obtained from a linear portion (an exponential tail) of a function expressed by Equation (I) defined below with photon energy (hν) as an independent variable and absorption coefficient (α) of photoabsorption spectrum as a dependent variable:

$$ln\alpha=(1/Eu)\cdot h\nu+\alpha_1 \quad \text{(I)}$$

and having mutually different contents of hydrogen atoms and optical band gaps in respectively specific ranges, and wherein the ratio of the thickness of the second layer region to the thickness of the photoconductive layer is in a fixed range.

17 Claims, 9 Drawing Sheets

LIGHT RECEIVING MEMBER FOR ELECTROPHOTOGRAPHY AND FABRICATION PROCESS THEREOF

BACKGROUND OF THE INVENTION

1. Field of the Invention

The present invention relates to a light receiving member for electrophotography and a fabrication process thereof and, more particularly, to a light receiving member for electrophotography provided with a photoconductive layer comprising a non-monocrystal material the matrix of which is silicon atoms, and a fabrication process thereof.

2. Related Background Art

In the field of image formation the following characteristics are required of photoconductive materials for forming a light receiving layer of the light receiving member. That is, they should have high sensitivity, high SN ratios (photocurrent (Ip)/dark current (Id)), absorption spectra matching with spectral characteristics of electromagnetic waves injected into the light receiving member, quick optical response, and desired dark resistance, they should be harmless to the human body during operation, and so on. Especially, when the light receiving member is incorporated in an electrophotographic apparatus used as a business machine at office, the harmlessness during operation as described above is important.

Hydrogenated amorphous silicon is one of the photoconductive materials exhibiting excellent characteristics and an example of application thereof to the light receiving member for electrophotography is described in U.S. Pat. No. 4,265,991.

The light receiving member of this type is usually made by heating an electroconductive substrate at 50° C. to 350° C. and forming a photoconductive layer of amorphous silicon on this substrate by a film-forming process such as the vacuum vapor deposition process, the sputtering process, the ion plating process, the thermal CVD process, the optical CVD process, or the plasma CVD process. Among others, the fabrication process by the plasma enhanced CVD process is preferred and is used in practice. This plasma CVD process is a process for decomposing a source gas by high-frequency or microwave glow discharge and forming a deposited film of amorphous silicon on the photoconductive substrate.

Also proposed in U.S. Pat. No. 5,382,487 is the light receiving member for electrophotography in which the photoconductive layer of amorphous silicon containing halogen atoms is formed on the conductive substrate. In this U.S. patent, the amorphous silicon contains 1 to 40 atomic % of halogen atoms, which enhances heat resistance and which permits the photoconductive layer of the light receiving member for electrophotography to have good electrical and optical characteristics.

Japanese Patent Application Laid-open No. 57-115556 describes the technology for forming a surface barrier layer of a non-photoconductive, amorphous material containing silicon atoms and carbon atoms on the photoconductive layer of an amorphous material the matrix of which is silicon atoms, in order to improve the electrical, optical, and photoconductive characteristics such as the dark resistance, photosensitivity, and optical response, operating circumstance characteristics such as humidity resistance, and aging resistance.

U.S. Pat. No. 4,788,120 describes the technology using an amorphous material containing components of silicon atoms, carbon atoms, and 41 to 70 atomic % of hydrogen atoms for the surface layer.

Japanese Patent Application Laid-open No. 62-83470 discloses the technology for obtaining high-quality images without ghost phenomenon by keeping characteristic energy of exponential tail of photoabsorption spectrum not more than 0.09 eV in the photoconductive layer of a photosensitive member for electrophotography.

Japanese Patent Application Laid-open No. 58-21257 discloses the technology for obtaining the photosensitive member with high resistance and with a wide photosensitive region by changing the temperature of the substrate during formation of the photoconductive layer, thereby changing the band gap in the photoconductive layer.

Japanese Patent Application Laid-open Nos. 59-143379 and 61-201481 disclose the technology for obtaining a photosensitive member with high dark resistance and with high sensitivity by stacking hydrogenated amorphous silicon layers of different hydrogen contents.

On the other hand, Japanese Patent Application Laid-open No. 60-95551 discloses the technology for, in order to enhance the quality of image of the amorphous silicon photosensitive member, carrying out image forming steps of charging, exposure, development, and transfer while maintaining temperatures near the surface of a photosensitive member at 30° C. to 40° C., thereby preventing decrease of surface resistance due to adsorption of water in the surface of a photosensitive member and thus preventing image smearing occurring therewith.

These techniques improved the electrical characteristics, optical characteristics, photoconductive characteristics, and operating circumstance characteristics of a light receiving member for electrophotography and also improved the quality of image therewith.

The conventional light receiving members for electrophotography having the photoconductive layer made of the amorphous silicon based material, however, were improved in performance in each of the electrical characteristics, optical characteristics, photoconductive characteristics, operating circumstance characteristics, and durability, but they were not sufficient in the total aspect yet and there is still room for further improvement.

Particularly, improvements in the quality of image, copying speed, and durability of electrophotographic apparatus are rapid, while the light receiving member for electrophotography needs to be further improved in the electrical characteristics and photoconductive characteristics and to be greatly enhanced in performance under all circumstances while maintaining the chargeability and sensitivity. As a consequence of accomplishment of improvements in optical exposure device, developing device, transferring device, etc. in the electrophotographic apparatus in order to improve the image characteristics of electrophotographic apparatus, the light receiving member for electrophotography was required to have higher image characteristics than heretofore.

Under the above circumstances the aforementioned conventional techniques enabled one to achieve some improvement in characteristics as to the above problems, but they are not sufficient yet as to further improvements in the chargeability and the quality of image. Especially, for achieving still higher image quality of the amorphous silicon based light receiving member, demands are becoming higher and higher for suppressing variation of electrophotographic characteristics (such as chargeability) due to change in ambient temperature (improvement in operating circumstance characteristics) and for decreasing the optical memory such as blank memory or ghost (improvement in the photoconductive characteristics).

For example, a method employed for preventing the so-called image smearing on the surface of a photosensitive member is to keep the surface temperature of a photosensitive member at about 40° C. by a drum heater mounted in a copier, as described aforementioned Japanese Patent Application Laid-open No. 60-95551. The conventional photosensitive member, however, had strong temperature dependence on chargeability because of generation of pre-exposure carriers or thermally excited carriers. Accordingly, it must be used in a state of lower chargeability during practical operation circumstances in the copier than in its original higher chargeable state. For example, the chargeability was approximately 100 V lower when heated to about 40° C. by the drum heater than during operation at room temperature.

In some cases, the drum heater is powered even during non-operating periods of the copier (for example, during the night), thereby preventing the image smearing caused by adsorption of ozone products, produced by corona discharge of charging device, to the surface of a photosensitive member. However, the supply of power during the night or the like when the copier is not used is avoided as much as possible for power saving currently. If the copying operation is started from the state without supply of power, the temperature will increase gradually around the photosensitive member in the copier and the chargeability will be lowered therewith. This caused a phenomenon that the density of image varied during the copying operation.

Further, continuous and repetitive copying operations with the same original posed problems on the improvement in the quality of image, including a phenomenon that a residual image of image exposure in a preceding copying step remained on an image upon further copying (ghost), a phenomenon that a density difference occurred on a copy image because of blank exposure of irradiation of a photosensitive member between sheets during continuous copying operations in order to save the toner (blank memory), and so on.

On the other hand, with the spread of use of computers to offices and ordinary households in recent years, the electrophotographic apparatus is being required to be digitized in order to function not only as a copier as before, but also as a facsimile machine or as a printer. The majority of semiconductor lasers and LEDs used as an exposure light source for that purpose are those of relatively long wavelengths ranging from near infrared to red visible light in terms of radiation intensity. Therefore, they were required to solve problems on characteristics which have never been raised with conventional analog machines using halogen light.

Especially, with use of the semiconductor lasers or LEDs, characteristics drawing attention were shifting of the relation between exposure value and surface potential of a photosensitive member, so called E-V characteristic (curve), depending upon temperature (temperature characteristic of sensitivity) and degradation of linearity (linearity of sensitivity) of the E-V characteristic (curve). Namely, in digital machines using the semiconductor laser or the LED as an exposure light source, when the temperature of a photosensitive member was not controlled by the drum heater described above, the temperature characteristic of sensitivity and the degradation of linearity of sensitivity posed a new problem that the sensitivity varied depending upon the ambient temperature to change the density of image.

It is, therefore, considered that in designing the light receiving member for electrophotography it is necessary to achieve improvements from all viewpoints including the layer structure, the chemical composition of each layer, and so on and to achieve further improvements in characteristics of the amorphous silicon based materials per se.

SUMMARY OF THE INVENTION

An object of the present invention is to solve the problems in the light receiving members for electrophotography having the light receiving member of the amorphous silicon based material described above.

Specifically, a principal object of the present invention is to provide a light receiving member for electrophotography achieving a totality of improvement together in chargeability, improvement in temperature characteristic thereof, and reduction of optical memory on a high level, thereby achieving a breakthrough improvement in the quality of image.

A further object of the present invention is to provide a light receiving member for electrophotography achieving improvements in the temperature characteristic of sensitivity and in the linearity of sensitivity in use of the semiconductor laser or LED as an image exposure light source, thereby achieving a breakthrough improvement in the quality of image.

A further object of the present invention is to provide a light receiving member for electrophotography comprising a substrate at least a surface of which is electrically conductive, and a photoconductive layer formed of a non-monocrystal material containing at least either hydrogen atoms or halogen atoms in the matrix of silicon atoms, wherein the photoconductive layer has a first layer region, the first layer region being formed as a film in which characteristic energy (Eu) obtained from a linear portion (an exponential tail) of a function expressed by Equation (I) defined below with photon energy (hν) as an independent variable and absorption coefficient (α) of photoabsorption spectrum as a dependent variable:

$$ln\alpha=(1/Eu)\cdot h\nu+\alpha_1 \quad \text{(I)}$$

is not more than 55 meV, in which a content (Ch) of hydrogen atoms and/or halogen atoms is not less than 25 atomic % and less than 40 atomic %, and in which an optical band gap (Eg) is not less than 1.8 eV and less than 1.9 eV, and a second layer region, the second layer region being formed as a film in which Eu is not more than 55 meV, Ch is not less than 10 atomic % and less than 25 atomic %, and Eg is not less than 1.7 eV and less than 1.8 eV, and wherein a ratio of a thickness of the second layer region to a total thickness of the photoconductive layer is 0.03–0.5.

A still further object of the present invention is to provide a process for fabricating a light receiving member for electrophotography in which a photoconductive layer is provided on a substrate at least having an electrically conductive surface, the process comprising:

a step of forming a first layer region of the photoconductive layer under such conditions that characteristic energy (Eu) obtained from a linear portion (an exponential tail) of a function expressed by Equation (I) defined below with photon energy (hν) as an independent variable and absorption coefficient (α) of photoabsorption spectrum as a dependent variable:

$$ln\alpha=(1/Eu)\cdot h\nu+\alpha_1 \quad (I)$$

is not more than 55 meV, a content (Ch) of hydrogen atoms and/or halogen atoms is not less than 25 atomic % and less than 40 atomic %, and an optical band gap (Eg) is not less than 1.8 eV and less than 1.9 eV; and a step of forming a second layer region of the photoconductive layer under such conditions that Eu is not more than 55 meV, Ch is not less than 10 atomic % and less than 25 atomic %, and Eg is not less than 1.7 eV and less than 1.8 eV.

DETAILED DESCRIPTION OF THE PREFERRED EMBODIMENTS

For solving the above problems, the inventors intensively and extensively studied the relationship of the temperature characteristic and the optical memory with localized state density distribution in the band gap of amorphous silicon based material (hereinafter referred to as "a-Si"), noting the behavior of carriers in the photoconductive layer. As a consequence, the inventors have found that the above objects were able to be achieved by controlling the hydrogen content, the optical band gap, and the localized state density distribution in the band gap in the direction of thickness of the photoconductive layer.

Specifically, it was found that in light receiving members for electrophotography having the photoconductive layer made of a non-monocrystal material containing at least either hydrogen atoms or halogen atoms in the matrix of silicon atoms, the light receiving members the layer structure of which was specified exhibited most excellent characteristics in practical use and were excellent in all respects as compared with the conventional light receiving members and that they had excellent characteristics, especially, as light receiving members for electrophotography.

Further, the inventors have found that the temperature characteristic of sensitivity and the linearity of sensitivity were also able to be improved by controlling the hydrogen content, the optical band gap, and the localized state density distribution in the band gap in a light incidence portion involved in photoelectric conversion where long-wavelength light (the semiconductor laser or the LED) was used as an image exposure light source.

Further, the inventors have found that adhesion to the substrate or to the preventing layer was increased and uniformity of image density (so called image coarseness) was also improved by controlling the hydrogen content, the optical band gap, and the localized state density distribution in the band gap, in an interface region to the substrate or to the preventing layer.

The term "light" stated in the present invention generally means light in a broad sense and covers electromagnetic waves including ultraviolet rays, visible rays, infrared rays, X-rays, and γ-rays.

The terms "exponential tail" and "characteristic energy" stated in the present invention will be described in detail referring to FIG. 1.

Figure 1:
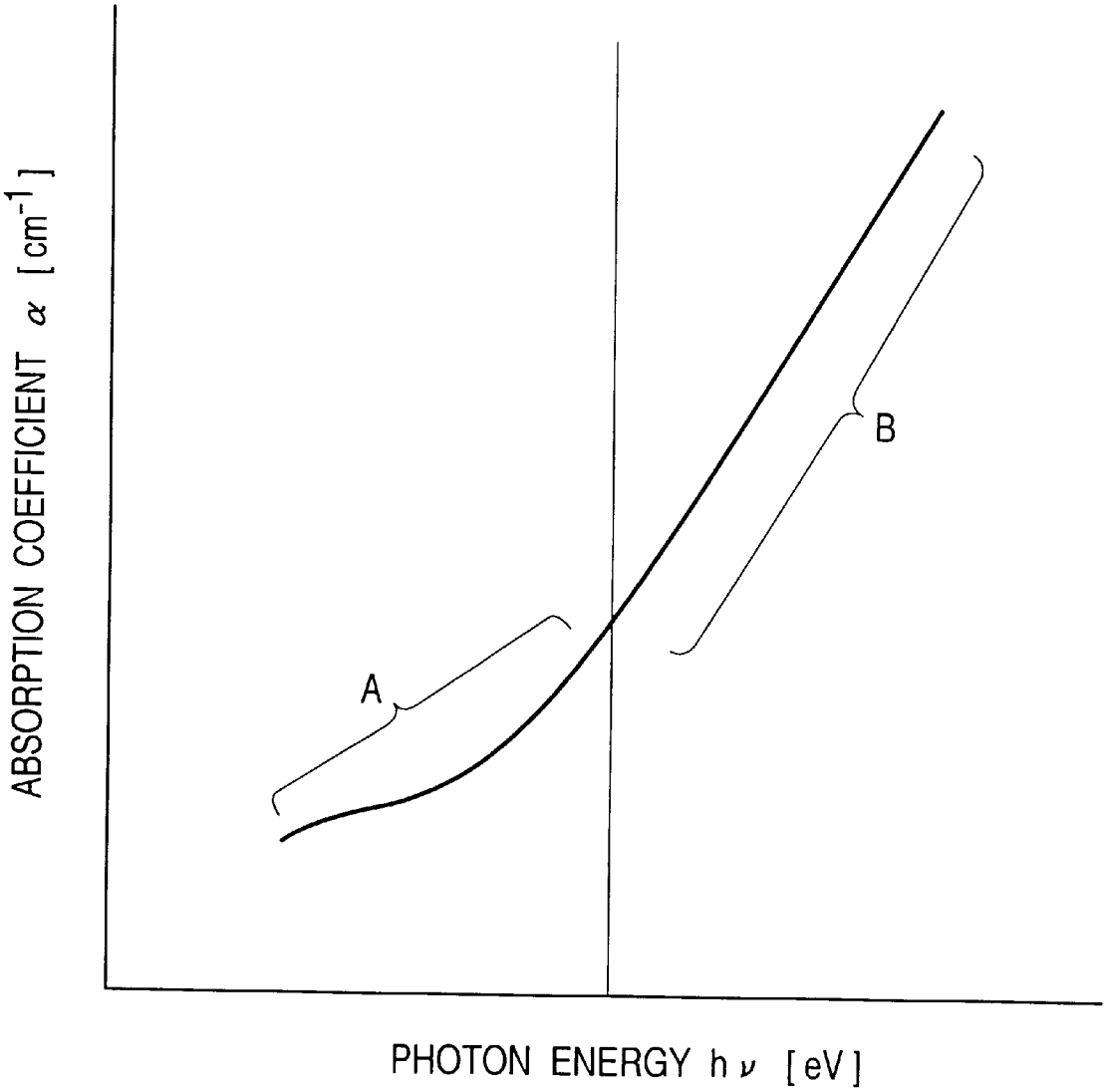
FIG. 1 is an explanatory view to show an example of photoabsorption spectrum of one sub band gap of amorphous silicon, for explaining the characteristic energy of the exponential tail.

FIG. 1 shows an example of photoabsorption spectrum of sub band gap of a-Si where the abscissa represents photon energy hν and the ordinate as a logarithmic axis for the absorption coefficient α. This spectrum can be divided roughly into two regions. Specifically, the two regions are region B where the absorption coefficient α changes exponentially against photon energy hν, that is, linearly in FIG. 1 ("exponential tail" or "Urback tail") and region A where the absorption coefficient α shows gentler dependence on the photon energy hν.

The above region B corresponds to optical absorption by optical transition from the tail level on the valence band side to the conduction band in a-Si and the exponential dependence of absorption coefficient α on photon energy hν in the region B is expressed by the following equation.

$$\alpha=\alpha_0\exp(h\nu/Eu)$$

Taking the logarithm for the both sides, the following equation is obtained.

$$ln\alpha=(1/Eu)\cdot h\nu+\alpha_1$$

where $\alpha_1=\ln\alpha_0$ (constant). Thus, the reciprocal of characteristic energy Eu (i.e., 1/Eu) represents the slope of the region B. Since Eu corresponds to the characteristic energy of exponential energy distribution of tail level on the valance band side, smaller Eu means less tail levels on the valence band side.

Next, the temperature characteristic of sensitivity and the linearity of sensitivity in the present invention will be described referring to FIG. 2.

Figure 2:
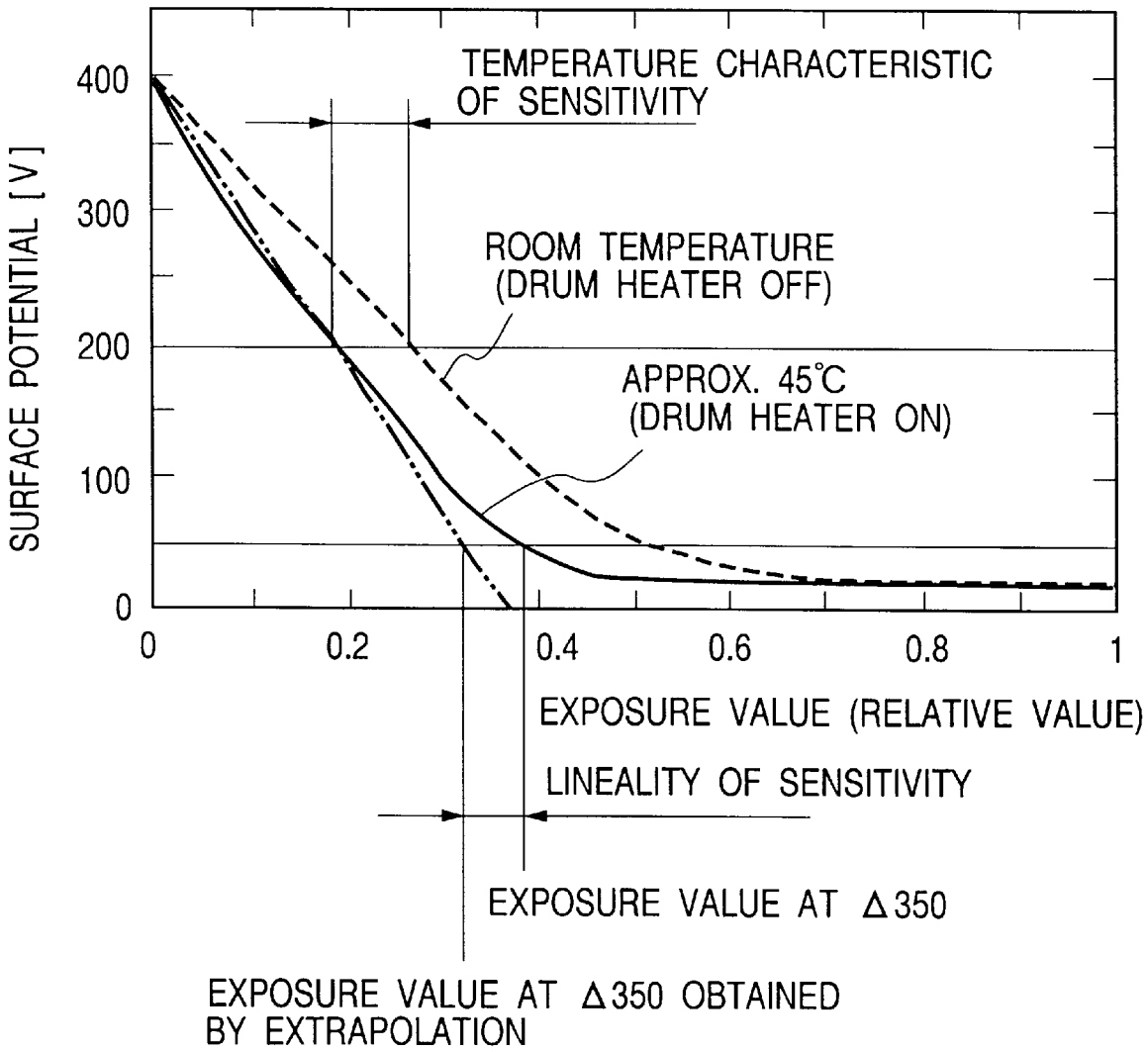
FIG. 2 is an explanatory view to show an example of exposure value-surface potential curve of an amorphous silicon photosensitive member, for explaining the temperature characteristic of sensitivity and the linearity of sensitivity.

FIG. 2 illustrates an example of change in the surface potential (light potential), i.e., the E-V characteristic (E-V curve) against change in exposure value where the photosensitive member is charged to the surface potential of 400 V as a dark potential at room temperature (the drum heater OFF) and at about 45° C. (the drum heater ON) and is then exposed to LED light of 680 nm as an exposure light source. The exposure values are indicated as relative values with respect to an exposure value at the lower limit of surface potential being 1.

The temperature characteristic of sensitivity is a difference between a value at room temperature and a value at about 45° C. of exposure value (half exposure value) where the difference between dark potential and light potential is 200 V (Δ200).

The linearity of sensitivity is a difference between an exposure value (actually measured value) where the difference between dark potential and light potential is 350 V (Δ350) and an exposure value (calculated value) where the difference is Δ350, obtained by extrapolating a straight line connecting a point of no exposure (in the dark state) with a point in a state irradiated with the half exposure value.

As either of the temperature characteristic of sensitivity and the linearity of sensitivity becomes smaller, the photosensitive member will exhibit better characteristics.

The inventors checked the correlation of characteristics of a photosensitive member with the optical band gap (hereinafter referred to as "Eg") and the above-stated characteristic energy of exponential tail (hereinafter referred to as "Eu") under various conditions and found that Eg and Eu were in close relation with the chargeability, temperature characteristic, and optical memory of an a-Si photosensitive member and further that good characteristics of a photosensitive member were demonstrated by stacking layers of different Eg, thus accomplishing the present invention.

Particularly, the inventors investigated Eg and Eu of light incidence portion and the characteristics of a photosensitive member in detail when using the semiconductor laser or the LED as an image exposure light source and found that Eg and Eu were in close relation with the temperature characteristic of sensitivity and the linearity of sensitivity, thereby demonstrating that the characteristics of a photosensitive member suitable for long-wavelength light such as the semiconductor laser or the LED were obtainable by controlling Eg and Eu of light incidence portion within specific ranges, thus achieving the present invention.

Namely, experiments by the inventors have clarified that the temperature characteristic was improved and the optical memory was substantially eliminated while enhancing the chargeability by using a layer region with large Eg and with a small trapping rate of carriers into localized levels as a main photoconductive layer and that the temperature characteristic of sensitivity and the linearity of sensitivity were improved greatly by placing a layer region with small Eg and with a small trapping rate of carriers into localized levels on the surface side of a photoconductive layer to be used as a photoelectric conversion portion.

It was also clarified that by using a layer region with large Eg and with a small trapping rate of carriers into localized levels as a main photoconductive layer and placing a layer region with a small optical band gap and with a small trapping rate of carriers into localized levels on the substrate or preventing layer side, the improvement in the temperature characteristic and the decrease of optical memory both were achieved while enhancing the chargeability, adhesion was further enhanced so as to sufficiently resist increase in stress due to stacking of layers on a small-diameter substrate, and uniformity (so called image coarseness) of image density in a small region was also improved.

These will be described in further detail. In general, in the band gap of a-Si:H there exist tail levels based on structural disorder of the Si—Si bond and deep levels originating from structural defects such as unbound bonds (dangling bonds) of Si. It is known that these levels serve as centers of capture and recombination of electrons and holes and act to degrade characteristics of the device.

Methods for measuring states of such localized levels in the band gap generally include the deep-level spectroscopy, the isothermal capacitance transient spectroscopy, the photothermal deflection spectroscopy, the optoacoustic spectroscopy, the constant photocurrent method, and so on. Among them, the constant photocurrent method (hereinafter referred to as "CPM") is useful as a method for easily measuring the photoabsorption spectrum of sub band gap based on the localized levels of a-Si:H.

The following can be considered as causes to degrade the chargeability with application of heat to the photosensitive member by the drum heater or the like (the temperature dependence of chargeability). Thermally excited carriers are attracted by an electric field upon charging and move to the surface as repeating trapping/emission into or out of the localized levels of band tail and the deep localized levels in the band gap, thereby canceling the surface charge. At this time, the carriers reaching the surface during passage through the charging device (during charging) show little effect on degradation of chargeability, but the carriers trapped in the deep levels reach the surface after passage through the charging device (after charging) to cancel the surface charge, thereby being observed as the temperature characteristic (degradation of chargeability). The carriers thermally excited after passage through the charging device also cancel the surface charge to cause degradation of chargeability. Therefore, it is necessary to expand the optical band gap to suppress generation of thermally excited carriers or to increase mobility of carriers, in order to enhance the temperature characteristic.

The optical memory takes place when photocarriers produced by blank exposure or image exposure are trapped in the localized levels in the band gap to cause some carriers to remain in the photoconductive layer. Namely, the carriers remaining in the photoconductive layer out of the photocarriers produced in a certain copying step are swept out by an electric field due to the surface charge during the next charging or after, so as to make a potential of the portion irradiated with light, lower than those of the other portions, resulting in a density difference on an image. Therefore, mobility of carriers needs to be improved so that as many photocarriers may move during one copying step without remaining in the photoconductive layer as possible.

The temperature characteristic of sensitivity is caused because there is a large difference between mobilities of electrons and holes in the photoconductive layer and because the mobilities change depending upon the temperature. When carriers (electron-hole pairs) are produced in the light incidence portion and when the charge is positive, the electrons move to the surface layer while the holes move to the substrate. With the semiconductive laser or the LED, the light goes deeply because of the relation between the wavelength thereof and the absorption coefficient of a-Si (amorphous silicon), thus making the generation region of carrier thicker. If the holes and electrons coexist in the light incidence portion, a rate of recombination thereof before arrival at the substrate or at the surface will be increased. Since the rate of recombination varies depending upon thermal excitation from the trapping centers, the exposure value, i.e., the number of photogenerated carriers and the number of carriers to cancel the surface potential, will change depending upon the temperature, so that the sensitivity will change depending upon the temperature. It is thus necessary to increase absorptance of light and to improve mobility of carriers so as to decrease the rate of recombination in the light incidence portion, i.e., so as to decrease the deep levels, which would be trapping centers, and so as to minimize the coexisting region of holes and electrons.

The linearity of sensitivity takes place because the number of photogenerated carriers at deep levels from the surface relatively increases with increase in exposure value of semiconductor laser or LED to increase transit distances of carriers (electrons in the case of the positive charge) necessary for canceling of surface charge. Therefore, it is necessary to increase the absorptance of light of the light incidence portion and to improve mobility of electrons and mobility of holes in the light incidence portion in a good balance.

Accordingly, if the light incidence portion is constructed of a layer region (second layer region) with decreased Ch, smaller Eg, and controlled (decreased) Eu, the rate of thermally excited carriers and photocarriers trapped in the localized levels can be decreased, which improves the mobility of carriers. The smaller Eg increases absorption of long-wavelength light, which allows the light incidence portion to be made thinner. This can decrease the coexisting region of holes-electrons. In addition, the photoconductive layer on the substrate side can be constructed in such layer design that main carriers are holes and the mobility thereof is improved. On the other hand, when a layer region (first layer region) with increased Ch, expanded Eg, and controlled (decreased) Eu is provided as a principal photoconductive layer on the substrate side, generation of thermally excited carriers can be restricted to decrease the rate of thermally excited carriers and photocarriers trapped in the localized levels, which achieves a breakthrough improvement in the mobility of carriers.

Namely, by providing the first layer region as a principal photoconductive layer on the substrate side, remarkable effects are recognized on improvement of the chargeability, temperature characteristic, and optical memory; by providing the second layer region as a layer region for substantially absorbing light on the surface side, the temperature characteristic of sensitivity and the linearity of sensitivity are improved greatly, especially, in use of the semiconductor laser or the LED as an image exposure light source.

The present invention, based on the above idea, can solve all of the various problems in the aforementioned conventional techniques for achieving enhancement of chargeability, enhancement of temperature characteristic, and decrease of optical memory and also keeping both the temperature characteristic of sensitivity and the linearity of sensitivity on a high level in use of the semiconductor laser or the LED as an image exposure light source, thus obtaining the light receiving member for electrophotography extremely excellent in the electrical, optical, and photoconductive characteristics, the quality of image, the durability, and the operating circumstance characteristics.

Another layer structure is such that a layer region (first layer region) with increased Ch, expanded Eg, and controlled (decreased) Eu is provided as a principal photoconductive layer on the surface side, which can suppress generation of thermally excited carriers and which can decrease the rate of thermally excited carriers and photocarriers trapped in the localized levels, thus achieving a breakthrough improvement in the mobility of carriers. On the other hand, when a layer region (second layer region) with decreased Ch, smaller Eg, and controlled (decreased) Eu is provided on the substrate side, the rate of thermally excited carriers and photocarriers trapped in the localized levels can be decreased, which achieves a breakthrough improvement in the mobility of carriers to improve fine nonuniformity of image density (image coarseness) and which enhances adhesion to the substrate or to the charge injection preventing layer to facilitate applications to smaller-diameter substrates than before.

Namely, by the arrangement wherein the first layer region is provided as a region for substantially absorbing light on the surface side of the photoconductive layer and wherein the second layer region is provided on the substrate side, remarkable effects are recognized on improvement of the chargeability, temperature characteristic, optical memory, image coarseness, and adhesion.

The present invention, based on the above idea, can solve the various problems in the aforementioned conventional techniques as achieving enhancement of chargeability, enhancement of temperature characteristic, and decrease of optical memory on a high level, thus obtaining the light receiving member for electrophotography extremely excellent in the electrical, optical, and photoconductive characteristics, the quality of image, the durability, and the operating circumstance characteristics.

The light receiving member for electrophotography according to the present invention will be described in detail with reference to the drawings.

FIGS. 3A–3E are schematic, structural views, each for explaining an example of the layer structure of the light receiving member for electrophotography according to the present invention.

Figure 3A:
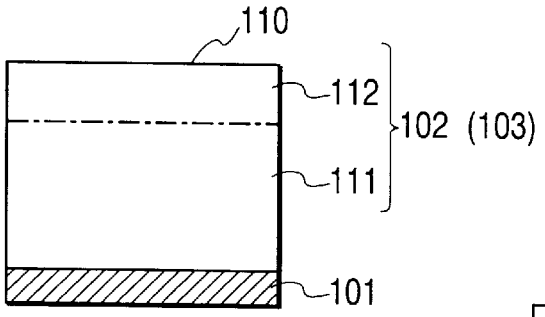
FIGS. 3A, 3B, 3C, 3D and 3E are schematic, explanatory views, each showing an example of layer structure of the light receiving member for electrophotography applicable to the present invention.

The light receiving member for electrophotography shown in FIG. 3A is constructed in such structure that a light receiving layer (102) is provided on the substrate (101) for a light receiving member for electrophotography. The light receiving layer is a photoconductive layer (103) with photoconductivity formed of amorphous silicon containing at least either hydrogen atoms or halogen atoms (hereinafter referred to as "a-Si: H, X") and the photoconductive layer has a first layer region (111) and a second layer region (112) in this order from the substrate side.

Figure 3D:
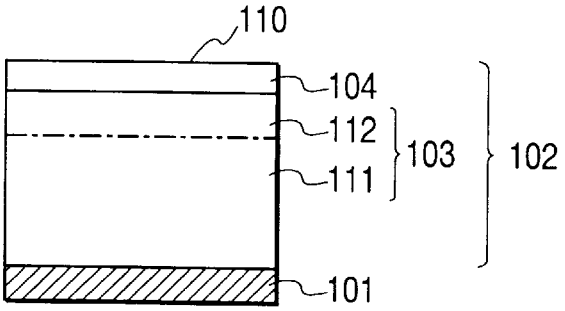
Figure 3B:
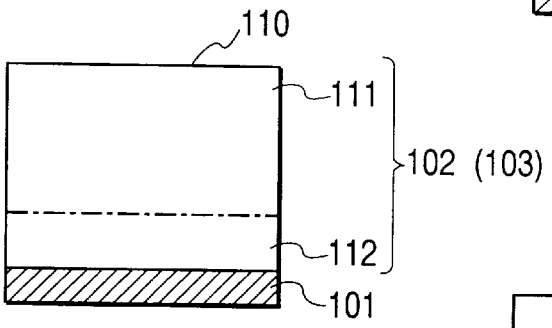

The light receiving member for electrophotography shown in FIG. 3B is constructed in such structure that the light receiving layer (102) is provided on the substrate (101) for a light receiving member for electrophotography. The light receiving layer is the photoconductive layer (103) with photoconductivity formed of a-Si: H, X and the photoconductive layer has a second layer region (112) and a first layer region (111) in this order from the substrate side.

Figure 3E:
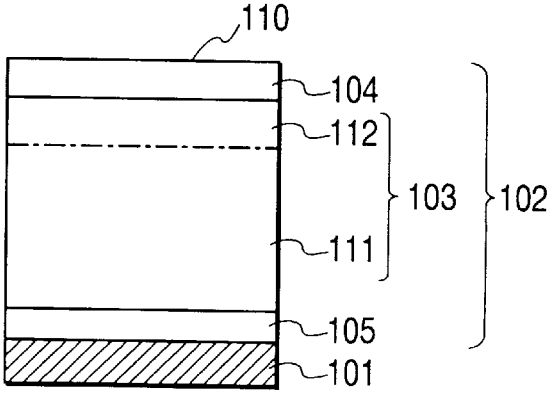
Figure 3C:
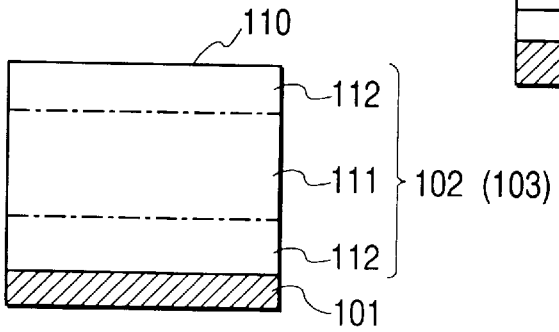

The light receiving member for electrophotography shown in FIG. 3C is constructed in such structure that the light receiving layer (102) is provided on the substrate (101) for light receiving member for electrophotography. The light receiving layer is the photoconductive layer (103) with photoconductivity formed of a-Si: H, X and the photoconductive layer has a second layer region (112), a first layer region (111), and another second layer region (112) in this order from the substrate side.

The light receiving member for electrophotography shown in FIG. 3D is constructed in such structure that the light receiving layer (102) is provided on the substrate (101) for light receiving member for electrophotography. The light receiving layer is comprised of the photoconductive layer (103) with photoconductivity formed of a-Si: H, X and an a-Si based surface layer (104). The photoconductive layer has a first layer region (111) and a second layer region (112) in this order from the substrate side. In this structure, the stacking order of the first layer region and the second layer region may be switched with necessity, and the photoconductive layer may be composed of a second layer region, a first layer region, and another second layer region in this order from the substrate side. (See FIGS. 3B and 3C.) The light receiving member for electrophotography shown in FIG. 3E is constructed in such structure that the light receiving layer (102) is provided on the substrate (101) for light receiving member for electrophotography. The light receiving layer has an a-Si based charge injection preventing layer (105), the photoconductive layer (103) with photoconductivity formed of a-Si: H, X, and the a-Si based surface layer (104) in this order from the substrate side. The photoconductive layer has a first layer region (111) and a second layer region (112) in this order from the charge injection preventing layer side. In this structure, the stacking order of the first layer region and the second layer region may be switched with necessity, and the photoconductive layer may be composed of a second layer region, a first layer region, and another second layer region in this order from the charge injection preventing layer side. (See FIGS. 3B and 3C.)

[Substrate]

The substrate used in the present invention may be an electrically conductive one or a one obtained by subjecting the surface of an electrically insulating member, at least on the side where the light receiving layer is made, to an electroconductive treatment. Examples of electrically conductive substrates are those of metals such as Al, Cr, Mo, Au, In, Nb, Te, V, Ti, Pt, Pd, or Fe, and alloys thereof, for example stainless steel or the like. Examples of the electrically insulating member for the substrate subjected to the electroconductive treatment are glass, ceramics, and films or sheets of synthetic resins such as polyester, polyethylene, polycarbonate, cellulose acetate, polypropylene, polyvinyl chloride, polystyrene, and polyamide.

The substrate used in the present invention may be of a cylindrical shape or endless belt shape having either a smooth surface or an uneven surface. The thickness of the substrate is determined properly so as to permit the light receiving member to be made as desired. When flexibility is required for the light receiving member, the substrate should be made preferably as thin as possible within the range wherein the function as the substrate can be demonstrated fully. However, the thickness of the substrate is normally determined to be preferably not less than 10 $\mu$m from the reasons of manufacturing, handling, mechanical strength, and so on.

Especially, when image recording is carried out with coherent light such as laser light (e.g., 788 nm), the surface of substrate may be provided with unevenness for effectively canceling image failure due to so-called interference fringe patterns appearing in a visible image. The unevenness provided in the surface of substrate is made by either one of well known methods described in Japanese Patent Application Laid-open Nos. 60-168156, 60-178457, 60-225854, and so on.

Another method for effectively canceling the image failure due to the interference fringe patterns in use of the coherent light such as the laser light (e.g., 788 nm) is a method for providing the surface of substrate with an uneven shape comprised of a plurality of spherical trace depressions. Namely, the surface of the substrate has finer unevenness than the resolution demanded for the light receiving member and the unevenness is of the plurality of spherical trace depressions. The unevenness by the plurality of spherical trace depressions provided in the surface of substrate is made by the conventional method described in Japanese Patent Application Laid-open No. 61-231561.

[Photoconductive layer]

In the present invention, for effectively achieving the objects thereof, the photoconductive layer, which is made on the substrate to constitute a part of the light receiving layer, is made by a vacuum deposit producing method while the numerical conditions of film-forming parameters are properly set so as to obtain desired characteristics. Specifically, it can be made by a variety of thin-film deposition methods, for example, glow discharge methods (AC discharge CVD processes such as the low-frequency CVD process, high-frequency CVD process, or microwave CVD process, the DC discharge CVD process, and the like), a sputtering process, a vacuum vapor deposition process, an ion plating process, an optical CVD process, and a thermal CVD process. One of these thin-film deposition methods is properly selected and employed depending upon such factors as production conditions, loads under capital investment on facilities, production scale, and desired characteristics for the light receiving member fabricated, but, in view of relatively easy control of conditions for producing the light receiving member with desired characteristics, a preferred method is one of the glow discharge processes and particularly preferred methods are high-frequency glow discharge processes using a power frequency in the RF band or in the VHF band.

For making the photoconductive layer by the glow discharge process, basically, the source gas for supply of Si capable of supplying silicon atoms (Si) and at least either the source gas for supply of H capable of supplying hydrogen atoms (H) or the source gas for supply of X capable of supplying halogen atoms (X) are introduced in a desired gas state into the reaction vessel, the internal pressure of which can be reduced, and glow discharge is made to take place in the reaction vessel, whereby the layer of a-Si: H, X is made on the predetermined substrate preliminarily set at a predetermined position.

In the present invention the photoconductive layer needs to contain at least either hydrogen atoms or halogen atoms, which are necessary and indispensable for compensating for the dangling bonds of silicon atoms and for improving the quality of layer, particularly for improving the photoconductive characteristics and charge holding characteristics. A content of hydrogen or halogen, or a total content of hydrogen and halogen is thus desirably determined to be not less than 25 atomic % and less than 40 atomic % with respect to the total content of silicon atoms and hydrogen atoms and/or halogen atoms in the case of the first layer region. In the case of the second layer region, it is not less than 10 atomic % and less than 25 atomic % with respect to the total content of silicon atoms and hydrogen atoms and/or halogen atoms.

Effectively applicable substances as the gas for supply of Si in the present invention include gas or gasifiable silicon hydrides (silanes) such as $SiH_4$, $Si_2H_6$, $Si_3H_8$, or $Si_4H_{10}$, among which $SiH_4$ and $Si_2H_6$ are preferable in terms of ease to handle upon production of layer, high supply efficiency of Si, and so on. Each gas may be a mixture of plural species at a predetermined mixture ratio without having to be limited to the single species.

For structurally introducing hydrogen atoms into the photoconductive layer to be formed, further facilitating control of introducing ratio of hydrogen atoms, and thereby obtaining film characteristics to achieve the objects of the present invention, it is necessary to form the layer by mixing the above gas with a desired amount of $H_2$ gas, a mixture gas of $H_2$ with He, or a gas of a silicon compound containing hydrogen atoms.

Preferred examples effectively applicable as the source gas for supply of halogen atoms in the present invention include gas or gasifiable halogen compounds such as halogen gases, halides, interhalogen compounds containing halogen atoms, or halogen-substituted silane derivatives. In addition, further examples effectively applicable are gas or gasifiable, halogen-containing, silicon hydride compounds comprised of constituents of silicon atoms and halogen atoms. Specific examples of the halogen compounds preferably applicable in the present invention are fluorine gas ($F_2$) and the interhalogen compounds such as BrF, ClF, $ClF_3$, $BrF_3$, $BrF_5$, $IF_3$, and $IF_7$. Specific examples of the silicon compounds containing halogen atoms, i.e., the so-called, halogen-substituted silane derivatives, preferably applicable are silicon fluorides such as $SiF_4$ and $Si_2F_6$.

An amount of hydrogen atoms and halogen atoms contained in the photoconductive layer, may be controlled, for example, by controlling the temperature of substrate, an amount of the raw-material substance used for introduction of at least either hydrogen atoms or halogen atoms into the reaction vessel, the discharge power, or the like.

In the present invention the photoconductive layer preferably contains the atoms for controlling the conductivity type as occasion may demand. The atoms for controlling the conductivity type may be contained in a uniformly distributed state all around in the photoconductive layer or may be contained in a nonuniformly distributed state in some portion in the direction of film thickness.

Examples of the atoms for controlling the conductivity type are so-called impurities in the semiconductor fields, more specifically, the atoms giving the p-type conduction characteristic and belonging to Group IIIb in the periodic table (hereinafter referred to as "IIIb-atoms") or the atoms giving the n-type conduction characteristic and belonging to Group Vb in the periodic table (hereinafter referred to as "Vb-atoms").

Specific examples of the IIIb-atoms are boron (B), aluminum (Al), gallium (Ga), indium (In), thallium (Tl), and so on and particularly, B, Al, and Ga are preferably applicable. Specific examples of the Vb-atoms are phosphorus (P), arsenic (As), antimony (Sb), bismuth (Bi), and so on and particularly, P and As are preferably applicable.

A content of the atoms for controlling the conductivity type, contained in the photoconductive layer, is determined to be preferably $1\times10^{-2}$ to 100 atomic ppm, more preferably $5\times10^{-2}$ to 50 atomic ppm, and most preferably $1\times10^{-1}$ to 10 atomic ppm.

For structurally introducing the atoms for controlling conductivity type, for example, the IIIb-atoms or the Vb-atoms, into the photoconductive layer, the raw-material substance for introduction of the IIIb-atoms or the raw-material substance for introduction of the Vb-atoms is introduced in a gas state together with the other gas for making the photoconductive layer into the reaction vessel, upon formation of layer.

The raw-material substance for introduction of the IIIb-atoms or the raw-material substance for introduction of the Vb-atoms is desirably those existing in a gas state at ordinary temperature and under ordinary pressure and those that can be gasified readily at least under the conditions for forming the layer. Examples of the raw-material substance for introduction of the IIIb-atoms are boron hydrides such as $B_2H_6$, $B_4H_{10}$, $B_5H_9$, $B_5H_{11}$, $B_6H_{10}$, $B_6H_{12}$, and $B_6H_{14}$ and boron halides such as $BF_3$, $BCl_3$, and $BBr_3$ for introduction of boron atoms. Other examples are $AlCl_3$, $GaCl_3$, $Ga(CH_3)_3$, $InCl_3$, $TlCl_3$, and so on. Examples of the raw-material substance for introduction of the Vb-atoms are phosphorus hydrides such as $PH_3$ and $P_2H_4$ and phosphorus halides such as $PH_4I$, $PF_3$, $PF_5$, $PCl_3$, $PCl_5$, $PBr_3$, $PBr_5$, and $PI_3$ for introduction of phosphorus atoms. Other examples effectively applicable as a starting material for introduction of the Vb-atoms are $ASH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$, and $BiBr_3$. These raw-materials substances for introduction of the atoms for controlling the conductivity type may be used as diluted with $H_2$ and/or Ne with necessity.

Further, the present invention is also valid when the photoconductive layer contains at least one species selected from the group consisting of carbon atoms, oxygen atoms, and nitrogen atoms. A content of carbon atoms, oxygen atoms, and nitrogen atoms is preferably $1\times10^{-5}$ to 10 atomic % with respect to the total content of silicon atoms, carbon atoms, oxygen atoms, and nitrogen atoms, more preferably $1\times10^{-4}$ to 8 atomic %, and most preferably $1\times10^{-3}$ to 5 atomic %. The at least one species selected from the group consisting of carbon atoms, oxygen atoms, and nitrogen atoms may be distributed all around and uniformly in the photoconductive layer or may have a portion with nonuniform distribution to change contents thereof in the direction of thickness of the photoconductive layer.

In the present invention, the thickness of the photoconductive layer is determined properly according to requirements in terms of capability of achieving desired electrophotographic characteristics, economical effect, and so on, and the thickness is preferably 20–50 $\mu$m, more preferably 23–45 $\mu$m, and most preferably 25–40 $\mu$m. If the thickness of layer is smaller than 20 $\mu$m, the electrophotographic characteristics including the chargeability, sensitivity, and so on will be insufficient for practical use; if the thickness is larger than 50 $\mu$m, the fabrication time of photoconductive layer will be lengthened, which will increase the production cost.

In the present invention, the ratio of the thickness of the second layer region to the thickness of the photoconductive layer (the first layer region+the second layer region) is preferably 0.03 to 0.5 where the thickness of the photoconductive layer is 1. If the ratio is smaller than 0.03 and if the second layer region is located on the surface layer side, it will fail to absorb pre-exposure or image exposure sufficiently, thus resulting in failing to fully demonstrating the improving effects of the temperature characteristic of sensitivity and the linearity of sensitivity. If the second layer region is located on the substrate side, it will fail to demonstrate the effects of enhancement of adhesion and improvement in image coarseness sufficiently. On the other hand, if the ratio of the thickness of the second layer region to the total thickness of the photoconductive layer (the first layer region +the second layer region) is over 0.5, it will fail to demonstrate the effects of enhancement of chargeability and improvement in the temperature characteristic of chargeability sufficiently.

For forming the photoconductive layer with desired film characteristics as achieving the objects of the present invention, it is necessary to properly set the mixture ratio of the gas for supply of Si with dilution gas, the gas pressure inside the reaction vessel, the discharge power, and the temperature of substrate.

The optimum range of flow rate of $H_2$ or He used as a dilution gas is properly selected according to the layer design. In the case of the first layer region, the flow rate of $H_2$ or He is controlled against the gas for supply of Si, normally in the range of 4 to 20 times, preferably in the range of 5 to 15 times, and most preferably in the range of 6 to 10 times. In the case of the second layer region, the flow rate of $H_2$ or He is controlled against the gas for supply of Si, normally in the range of 0.5 to 10 times, preferably in the range of 1 to 8 times, and most preferably in the range of 2 to 6 times.

The optimum range of the gas pressure in the reaction vessel is also selected properly according to the layer design and the gas pressure is controlled normally in the range of $1\times10^{-2}$ to $2\times10^{3}$ Pa, preferably in the range of $5\times10^{-2}$ to $5\times10^{2}$ Pa, and most preferably in the range of $1\times10^{-1}$ to $2\times10^{2}$ Pa.

The optimum range of the discharge power is also selected properly according to the layer design. In the case of the first layer region, the ratio of discharge power against flow rate of gas for supply of Si (W/SCCM) is set preferably in the range of 3 to 10, more preferably in the range of 4 to 9, and most preferably in the range of 5 to 8. In the case of the second layer region, the ratio of discharge power against flow rate of gas for supply of Si is set preferably in the range of 0.3 to 5, more preferably in the range of 0.5 to 4, and most preferably in the range of 1 to 3. Especially, the ratio of discharge power against flow rate of gas for supply of Si, of the first layer region is preferably greater than that of the second layer region, and the formation thereof is carried out preferably in the so-called flow limit region.

The optimum range of the temperature of the substrate is selected properly according to the layer design and it is preferably 200° C.–350° C., more preferably 230° C.–330° C., and most preferably 250° C.–300° C.

Desired numerical ranges of the mixture ratio of gas, the gas pressure in the reaction vessel, the discharge power, and the temperature of substrate are those described above, but the conditions are not determined independently of each other. Optimum values of the conditions are desirably determined based on mutual and organic relation so as to form the light receiving member having the desired characteristics.

[Surface Layer]

In the present invention, it is preferable that an a-Si-based surface layer be formed further on the photoconductive layer which is formed on the substrate as described above. This surface layer has a free surface (110) and is provided for achieving the objects of the present invention mainly in moisture resistance, continuous and repetitive operation characteristics, withstand voltage (dielectric strength), operating circumstance characteristics, durability, and so on.

Since in the present invention each of amorphous materials for respectively making the photoconductive layer and the surface layer constituting the light receiving layer has the common constituent of silicon atom, chemical stability is fully assured at the interface between the stacked layers.

Any materials can be used for the surface layer so long as they are of a-Si. For example, preferred materials are amorphous materials containing silicon atoms, carbon atoms, and at least either hydrogen atoms (H) or halogen atoms (X) (hereinafter referred to as "a-SiC: H, X"), amorphous materials containing silicon atoms, oxygen atoms, and at least either hydrogen atoms (H) or halogen atoms (X) (hereinafter referred to as "a-SiO: H, X"), amorphous materials containing silicon atoms, nitrogen atoms, and at least either hydrogen atoms (H) or halogen atoms (X) (hereinafter referred to as "a-SiN: H, X"), and so on. Further, other preferred materials are amorphous materials containing silicon atoms, hydrogen atoms (H) and/or halogen atoms (X) and at least two selected from the group consisting of carbon atoms, oxygen atoms, and nitrogen atoms. These materials are generally called hereinafter as "a-SiCON: H, X."

In the present invention, for effectively achieving the objects thereof, the surface layer is made by the vacuum deposit producing method while the numerical conditions of film-forming parameters are properly set so as to obtain desired characteristics. Specifically, the surface layer may be made by a variety of thin-film deposition methods, for example, including the glow discharge methods (the AC discharge CVD processes such as the low-frequency CVD process, high-frequency CVD process, or microwave CVD process, the DC discharge CVD process, and the like), the sputtering process, the vacuum vapor deposition process, the ion plating process, the optical CVD process, and the thermal CVD process. One of these thin-film deposition methods is properly selected and employed depending upon such factors as production conditions, loads under capital investment on facilities, production scale, and desired characteristics for the light receiving member fabricated, but, in view of productivity of a light receiving member, a preferred method is the same deposition method as for the photoconductive layer.

For example, for making the surface layer of a-SiC: H, X by the glow discharge process, basically, the source gas for supply of Si capable of supplying silicon atoms (Si), the source gas for supply of C capable of supplying carbon atoms (C), and at least one selected from the source gas for supply of H capable of supplying hydrogen atoms (H) and the source gas for supply of X capable of supplying halogen atoms (X) are introduced in a desired gas state into the reaction vessel the internal pressure of which can be reduced, glow discharge is made to take place in the reaction vessel, and the layer of a-SiC: H, X is made on the substrate on which the photoconductive layer is preliminarily made at the predetermined position.

The surface layer used in the present invention can be preferably made of any material that is an amorphous silicon material. Preferred materials are amorphous materials containing at least one element selected from carbon, nitrogen, and oxygen and particularly preferred materials are a-SiC:H, X.

When the surface layer contains a-SiC as a main component, the content of carbon is preferably in the range of 30% to 90% against the total content of silicon atoms and carbon atoms.

In the present invention the surface layer needs to contain hydrogen atoms and/or halogen atoms, which are necessary and indispensable for compensating for the dangling bonds of silicon atoms and for improving the quality of layer, particularly for improving the photoconductive characteristics and charge holding characteristics. The content of hydrogen is determined to be normally 30 to 70 atomic %, preferably 35 to 65 atomic %, and most preferably 40 to 60 atomic % with respect to the total amount of constituent atoms. A content of fluorine atoms is determined to be normally 0.01 to 15 atomic %, preferably 0.1 to 10 atomic %, and most preferably 0.6 to 4 atomic %.

The light receiving members fabricated in the ranges of these hydrogen and fluorine contents are much more excellent than ever in practical aspect and can be applied well.

It is known that the defects existing in the surface layer (mainly, the dangling bonds of silicon atoms or carbon atoms) negatively affect the characteristics of the light receiving member for electrophotography. Examples of the negative effects are as follows: degradation of charging characteristics due to injection of charge from the free surface; change of charging characteristics due to change of surface structure under the operating circumstances, for example, under high humidity; occurrence of ghost phenomenon during repetitive operations because charges are injected into the surface layer from the photoconductive layer upon corona charging or upon light irradiation to be trapped by the defects in the surface layer, and so on. However, when the hydrogen content in the surface layer is controlled to not less than 30 atomic %, the defects in the surface layer are reduced greatly, so that breakthrough improvements can be made in electrical characteristics and in high-speed continuous operability, as compared with the conventional case. On the other hand, if the hydrogen content in the surface layer is over 70 atomic %, the hardness of the surface layer will be lowered, so that the surface layer would become undurable against repetitive use. Accordingly, the control of the hydrogen content in the surface layer within the aforementioned range is very important for achieving the extremely excellent, desired, electrophotographic characteristics. The hydrogen content in the surface layer can be controlled by the flow rates of source gases (a ratio thereof), the temperature of the substrate, the discharge power, the gas pressure, or the like.

The control of the fluorine content in the surface layer to be not less than 0.01 atomic % makes it possible to more effectively achieve generation of bonds of silicon atoms and carbon atoms in the surface layer. Further, the function of the fluorine atoms in the surface layer is to effectively prevent disconnection of bonds of silicon atoms and carbon atoms due to damage of corona or the like. However, when the fluorine content in the surface layer becomes over 15 atomic %, the effect of generation of bonds of silicon atoms and carbon atoms in the surface layer and the effect to prevent disconnection of bonds of silicon atoms and carbon atoms due to the damage of corona or the like can rarely be recognized. Further, since excessive fluorine atoms impede mobility of carriers in the surface layer, it makes the residual potential or image memory outstanding. Accordingly, controlling the fluorine content in the surface layer within the aforementioned range is important for achieving the desired electrophotographic characteristics. The fluorine content in the surface layer can be controlled by the flow rate of source gases (the ratio thereof), the temperature of the substrate, the discharge power, the gas pressure, or the like, as the hydrogen content can.

Effectively applicable substances as the gas for supply of Si used in the formation of the surface layer of the present invention include gas or gasifiable silicon hydrides (silanes) such as $SiH_4$, $Si_2H_6$, $Si_3H_8$, or $Si_4H_{10}$, among which $SiH_4$ and $Si_2H_6$ are preferable in terms of ease to handle upon production of layer, high supply efficiency of Si, and so on. These source gases for supply of Si may be used as diluted with a gas such as $H_2$, He, Ar, or Ne with necessity.

Substances effectively applicable as the gas for supply of carbon are gas or gasifiable hydrocarbons such as $CH_4$, $C_2H_2$, $C_2H_6$, $C_3H_8$, and $C_4H_{10}$ and particularly preferred substances are $CH_4$, $C_2H_2$, and $C_2H_6$ in terms of ease to handle upon production of the layer, high supply efficiency of C, and so on. These source gases for supply of C may be used as diluted with a gas such as $H_2$, He, Ar, or Ne with necessity.

Substances effectively applicable as the gas for supply of nitrogen or oxygen are gas or gasifiable compounds such as $NH_3$, NO, $N_2O$, $NO_2$, $O_2$, CO, $CO_2$, and $N_2$. These source gases for supply of nitrogen or oxygen may be used as diluted with a gas such as $H_2$, He, Ar, or Ne with necessity.

For further facilitating control of introduction ratio of hydrogen atoms introduced into the surface layer, it is preferred to form the layer by mixing these gases further with a desired amount of hydrogen gas or a gas of silicon compound containing hydrogen atoms. Here, each gas may be a mixture of plural species at a predetermined mixture ratio without having to be limited to the single species.

Preferred examples effectively applicable as the source gas for supply of halogen atoms include gas or gasifiable halogen compounds such as halogen gases, halides, interhalogen compounds containing halogen atoms, or halogen-substituted silane derivatives. In addition, further examples effectively applicable are gas or gasifiable, halogen-containing, silicon hydride compounds comprised of constituents of silicon atoms and halogen atoms. Specific examples of the halogen compounds preferably applicable in the present invention are fluorine gas ($F_2$) and the interhalogen compounds such as BrF, ClF, $ClF_3$, $BrF_3$, $BrF_5$, $IF_3$, and $IF_7$. Examples of the silicon compounds containing halogen atoms, i.e., the so-called, halogen-substituted silane derivatives, preferably applicable are silicon fluorides such as $SiF_4$ and $Si_2F_6$.

An amount of hydrogen atoms and/or halogen atoms contained in the surface layer, may be controlled, for example, by controlling the temperature of substrate, an amount of the raw-material substance used for introduction of the hydrogen atoms and/or halogen atoms into the reaction vessel, the discharge power, or the like.

The carbon atoms and/or the oxygen atoms and/or the nitrogen atoms may be contained in a uniformly distributed state all around in the surface layer or may be contained in a nonuniformly distributed state in some portion with changing contents in the direction of film thickness of the surface layer.

Further, in the present invention the surface layer preferably contains the atoms for controlling the conductivity type as occasion may demand. The atoms for controlling the conductivity type may be contained in a uniformly distributed state all around in the surface layer or may be contained in a nonuniformly distributed state in some portion in the direction of film thickness.

Examples of the atoms for controlling the conductivity type are so-called impurities in the semiconductor fields, more specifically, the atoms giving the p-type conduction characteristic and belonging to Group IIIb or the atoms giving the n-type conduction characteristic and belonging to Group Vb.

Specific examples of the IIIb-atoms are boron (B), aluminum (Al), gallium (Ga), indium (In), thallium (Tl), and so on and particularly, B, Al, and Ga are preferably applicable. Specific examples of the Vb-atoms are phosphorus (P), arsenic (As), antimony (Sb), bismuth (Bi), and so on and particularly, P and As are preferably applicable.

A content of the atoms for controlling the conductivity type, contained in the surface layer, is determined to be preferably in the range of $1\times10^{-3}$ to $1\times10^{3}$ atomic ppm, more preferably in the range of $1\times10^{-2}$ to $5\times10^{2}$ atomic ppm, and most preferably in the range of $1\times10^{-1}$ to $1\times10^{2}$ atomic ppm.

For structurally introducing the atoms for controlling conductivity type, for example, the IIIb-atoms or the Vb-atoms, into the surface layer, the raw-material substance for introduction of the IIIb-atoms or the raw-material substance for introduction of the Vb-atoms may be introduced in a gas state together with the other gas for making the surface layer into the reaction vessel, upon formation of layer.

The raw-material substance for introduction of the IIIb-atoms or the raw-material substance for introduction of the Vb-atoms is desirably selected from those existing in a gas state at ordinary temperature and under ordinary pressure and those that can be gasified readily at least under the conditions for forming the layer. Examples of the raw-material substance for introduction of the IIIb-atoms are boron hydrides such as $B_2H_6$, $B_4H_{10}$, $B_5H_9$, $B_5H_{11}$, $B_6H_{10}$, $B_6H_{12}$, and $B_6H_{14}$ and boron halides such as $BF_3$, $BCl_3$, and $BBr_3$ for introduction of boron atoms. Other examples are $AlCl_3$, $GaCl_3$, $Ga(CH_3)_3$, $InCl_3$, $TlCl_3$, and so on. Examples of the raw-material substance for introduction of the Vb-atoms are phosphorus hydrides such as $PH_3$ and $P_2H_4$ and phosphorus halides such as $PH_4I$, $PF_3$, $PF_5$, $PCl_3$, $PCl_5$, $PBr_3$, $PBr_5$, and $PI_3$ for introduction of phosphorus atoms. Other examples effectively applicable as a starting material for introduction of the Vb-atoms are $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$, and $BiBr_3$. These raw-material substances for introduction of the atoms for controlling conductivity type may be used as diluted with a gas such as $H_2$, He, Ar, or Ne with necessity.

The thickness of the surface layer in the present invention is determined to be normally 0.01 to 3 μm, preferably 0.05 to 2 μm, and most preferably 0.1 to 1 μm. If the thickness is smaller than 0.01 μm, the surface layer will be lost because of abrasion or the like during use of the light receiving member. If the thickness is over 3 μm, degradation of the electrophotographic characteristics, such as an increase in residual potential, will result.

The surface layer according to the present invention is made carefully so that the required characteristics thereof can be imparted thereto as desired. Namely, substances including the components of Si, and C and/or N and/or O, and H and/or X have a variety of properties depending upon their fabrication conditions; structural properties of from crystal to amorphous state (generally called as "non-monocrystal"), electro-physical properties of from the electrically conductive property to the semiconductive or electrically insulative property, and properties of from the photoconductive property to the non-photoconductive property. In the present invention, selection of the fabrication conditions is made strictly according to the desire so as to fabricate a compound having desired characteristics according to the purpose.

For example, if the surface layer is provided for the principal purpose of an improvement in dielectric strength, it will be made of a non-monocrystal material showing noticeable, electrical insulation behavior under operation circumstances. Further, when the surface layer is provided for the principal purpose of an improvement in continuous and repetitive operation characteristics or in operation circumstance characteristics, it may be made of a non-monocrystal material showing a somewhat relieved degree of the above electric insulation property and having some sensitivity to the light of irradiation.

For making the surface layer with the characteristics capable of achieving the objects of the present invention, it is necessary to properly set the temperature of the substrate and the gas pressure in the reaction vessel in accordance with the desire. The optimum range of the temperature (Ts) of the substrate is properly selected according to the layer design and in the normal case, it is preferably between 200° C. and 350° C., more preferably between 230° C. and 330° C., and most preferably between 250° C. and 300° C. The optimum range of the gas pressure in the reaction vessel is also properly selected similarly according to the layer design and in the normal case, it is preferably between $1\times10^{-2}$ and $2\times10^{3}$ Pa, more preferably between $5\times10^{-2}$ and $5\times10^{2}$ Pa, and most preferably between $1\times10^{-1}$ and $2\times10^{2}$ Pa. In the present invention, desired numerical ranges of the temperature of substrate and the gas pressure for forming the surface layer are those described above, but these conditions are not determined independently of each other in usual cases. Optimum values of the conditions are desirably determined based on mutual and organic relation so as to form the light receiving member having the desired characteristics.

In the present invention, addition of a blocking layer (lower surface layer) having a smaller content of carbon atoms, oxygen atoms, and nitrogen atoms than in the surface layer between the photoconductive layer and the surface layer is effective in further enhancing the characteristics of chargeability or the like.

It is also permissible to provide a region with decreasing contents of carbon atoms and/or oxygen atoms and/or nitrogen atoms toward the photoconductive layer between the surface layer and the photoconductive layer. This can enhance adhesion between the surface layer and the photoconductive layer, thereby promoting smooth movement of photocarriers to the surface and also decreasing the influence of interference due to reflection of light at the interface between the photoconductive layer and the surface layer.

[Charge Injection Preventing Layer]

In the light receiving member according to the present invention, the effect is more enhanced by providing the charge injection preventing layer functioning to prevent injection of charge from the conductive substrate side, between the conductive substrate and the photoconductive layer. Namely, the charge injection preventing layer has a function to prevent the charge from being injected from the substrate to the photoconductive layer when the light receiving layer is subjected to charging of a fixed polarity on the free surface thereof, and it has so-called polarity dependence that the function does not take place when the light receiving layer is subjected to charging of the opposite polarity.

For providing the charge injection preventing layer with this function, the charge injection preventing layer 105 contains a relatively larger amount of the atoms for controlling conductivity type than the photoconductive layer does. The atoms for controlling conductivity type may be distributed all around and uniformly in the layer, or some portion may contain the atoms in a nonuniformly distributed state though containing them all around in the direction of film thickness. In the case of the nonuniform distribution of concentration, a preferred distribution is one containing the atoms distributed more on the substrate side. In either case, however, the atoms need to be distributed uniformly and all around in the in-plane direction parallel to the surface of substrate in order to uniform the characteristics in the in-plane direction.

Examples of the atoms for controlling the conductivity type, contained in the charge injection preventing layer, are so-called impurities in the semiconductor fields, more specifically, the atoms giving the p-type conduction characteristic and belonging to Group IIIb in the periodic table (hereinafter referred to as "IIIb-atoms") or the atoms giving the n-type conduction characteristic and belonging to Group Vb in the periodic table (hereinafter referred to as "Vb-atoms").

Specific examples of the IIIb-atoms are boron (B), aluminum (Al), gallium (Ga), indium (In), thallium (Tl), and so on and particularly, B, Al, and Ga are preferably applicable. Specific examples of the Vb-atoms are phosphorus (P), arsenic (As), antimony (Sb), bismuth (Bi), and so on and particularly, P and As are preferably applicable. The raw-material substances for introduction of those atoms may be the same substances as those used in the photoconductive layer.

In the present invention, a content of the atoms for controlling conductivity type, contained in the charge injection preventing layer, is properly determined as desired to effectively achieve the objects of the present invention, which is determined to be preferably 10 to $1\times10^4$ atomic ppm, more preferably 50 to $5\times10^3$ atomic ppm, and most preferably $1\times10^2$ to $3\times10^3$ atomic ppm.

Further, when the charge injection preventing layer contains at least one species of carbon, nitrogen, and oxygen, adherence can be enhanced further to another layer provided in direct contact with the charge injection preventing layer. The carbon atoms, nitrogen atoms, and hydrogen atoms may be distributed all around and uniformly in the layer; or some portion may contain them in a nonuniformly distributed state though they are distributed all around in the direction of film thickness. In either case, however, the atoms need to be distributed uniformly and all around in the in-plane direction parallel to the surface of substrate in order to uniform the characteristics in the in-plane direction.

A content of carbon atoms and/or nitrogen atoms and/or oxygen atoms contained in the entire region of the charge injection preventing layer in the present invention is preferably determined so as to effectively achieve the objects of the present invention, and is determined to be preferably $1\times10^{-3}$ to 30 atomic %, more preferably $5\times10^{-3}$ to 20 atomic %, and most preferably $1\times10^{-2}$ to 10 atomic %, each of which, in the case of one species, is a content thereof or each of which, in the case of two or more species, is the sum of their contents.

Hydrogen atoms and/or halogen atoms contained in the charge injection preventing layer compensate for the unbound bonds present in the layer and are thus effective in improving the quality of film. A content of the hydrogen atoms or the halogen atoms or a total content of the hydrogen atoms and halogen atoms in the charge injection preventing layer is determined to be preferably 1 to 50 atomic %, more preferably 5 to 40 atomic %, and most preferably 10 to 30 atomic %.

In the present invention the thickness of the charge injection preventing layer is determined to be preferably 0.1 to 5 $\mu$m, more preferably 0.3 to 4 $\mu$m, and most preferably 0.5 to 3 $\mu$m in order to achieve the desired electrophotographic characteristics, economical effect, and so on. If the thickness is smaller than 0.1 $\mu$m, sufficient chargeability will not be obtained because of insufficient performance of preventing injection of charge from the substrate. On the other hand, if the thickness is over 5 $\mu$m, no improvement will be expected in the electrophotographic characteristics and increase in production cost will result because of longer fabrication time.

In the present invention, the charge injection preventing layer is formed by the same vacuum deposition method as in the formation of the photoconductive layer described above. For forming the charge injection preventing layer with the characteristics capable of achieving the objects of the present invention, it is necessary to properly set the mixture ratio of the gas for supply of Si and the dilution gas, the gas pressure in the reaction vessel, the discharge power, and the temperature of the substrate, as in the case of the photoconductive layer described above.

The optimum range of flow rate of $H_2$ or He used as the dilution gas is properly selected according to the design of layer, and $H_2$ or He is controlled against the gas for supply of Si normally in the range of 0.3 to 20 times, preferably in the range of 0.5 to 15 times, and most preferably in the range of 1 to 10 times.

The optimum range of the gas pressure in the reaction vessel is also properly selected according to the design of layer, and the gas pressure is controlled normally in the range of $1\times10^{-2}$ to $2\times10^3$ Pa, preferably in the range of $5\times10^{-2}$ to $5\times10^2$ Pa, and most preferably in the range of $1\times10^{-1}$ to $2\times10^2$ Pa.

The optimum range of the discharge power is also properly selected according to the design of layer, and the ratio of discharge power to flow rate of the gas for supply of Si (W/SCCM) is set normally in the range of 0.5 to 8, preferably in the range of 0.8 to 7, and most preferably in the range of 1 to 6.

The optimum range of the temperature of the substrate is selected properly according to the layer design and in the normal case, it is determined to be preferably between 200° C. and 350° C., more preferably between 230° C. and 330° C., and most preferably between 250° C. and 300° C.

In the present invention, the desired numerical ranges of the mixture ratio of dilution gas, the gas pressure, the discharge power, and the temperature of substrate for making the charge injection preventing layer are not determined independently of each other, and optimum values should be desirably determined based on mutual and organic relationship so as to make the charge injection preventing layer with desired characteristics.

In addition, the light receiving member according to the present invention may be arranged to have a layer region containing a nonuniform distribution of aluminum atoms, silicon atoms, and at least hydrogen atoms or halogen atoms in the direction of film thickness on the substrate side in the light receiving layer. For the purpose of further improving the adhesion between the substrate and the photoconductive layer or the charge injection preventing layer, the light receiving member according to the present invention may be provided with an adhesive layer constituted of, for example, $Si_3N_4$, $SiO_2$, SiO, or an amorphous material containing either hydrogen atoms or halogen atoms, and at least one selected from the group consisting of carbon atoms, oxygen atoms, and nitrogen atoms in the matrix of silicon atoms. Further, it may be provided with a light absorbing layer for preventing occurrence of interference patterns due to reflected light from the substrate.

[Apparatus and Film Forming Method for Making Light Receiving Layer]

Next, the apparatus and film forming method for making the light receiving layer will be described in detail.

Figure 4:
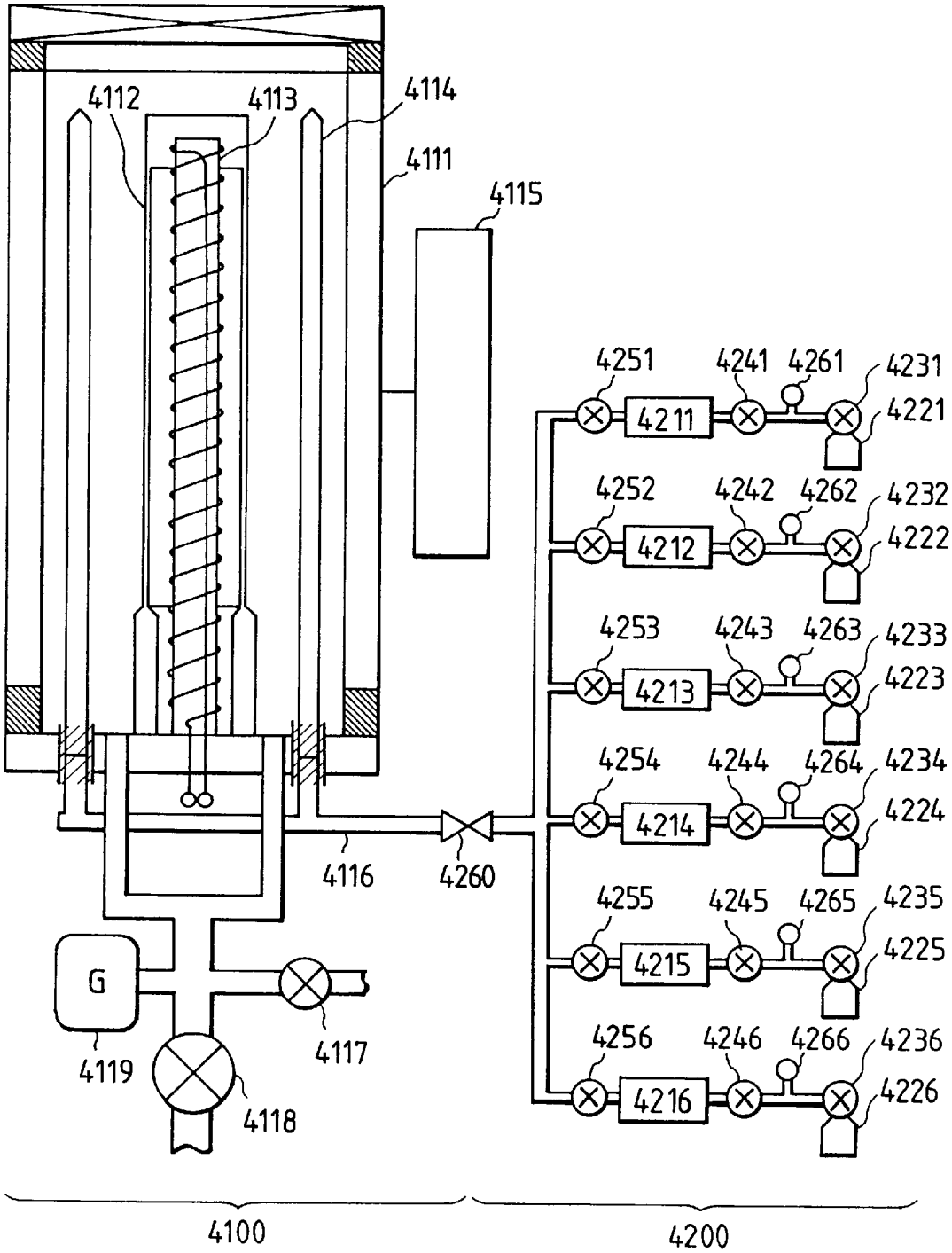
FIG. 4 is a schematic, structural view of an example of a fabrication system of the light receiving member for electrophotography.
Figure 5:
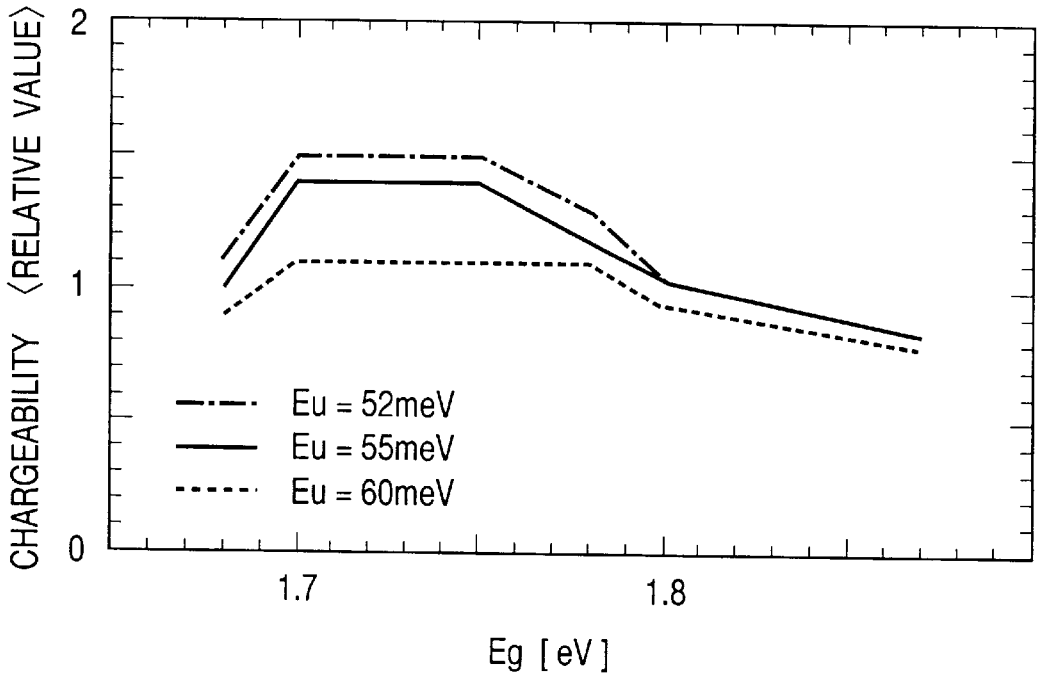
FIG. 5 is a view to show an example of relationship of chargeability to optical band gap (Eg) of the the second layer region in the photoconductive layer and to characteristic energy (Eu) of Urback tail.
Figure 6:
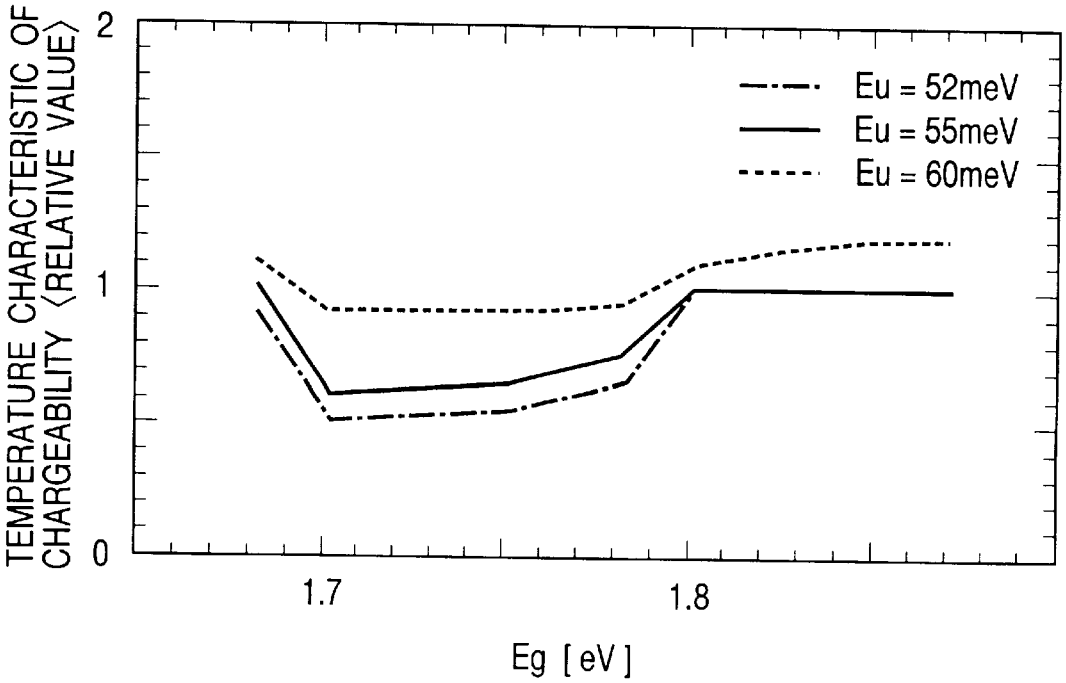
FIG. 6 is a view to show an example of relationship of temperature characteristic of chargeability to optical band gap (Eg) of the second layer region in the photoconductive layer and to characteristic energy (Eu) of the Urback tail.
Figure 7:
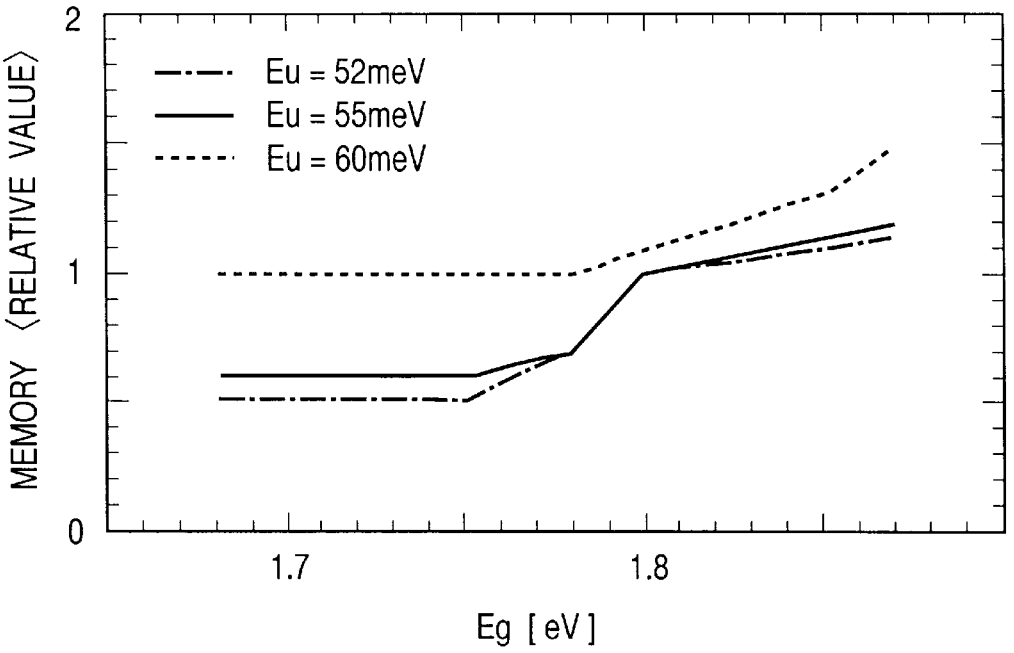
FIG. 7 is a view to show an example of relationship of memory to optical band gap (Eg) of the second layer region in the photoconductive layer and to characteristic energy (Eu) of the Urback tail.

FIG. 4 is a schematic, structural view to show an example of a fabrication system of the light receiving member by the radio-frequency plasma CVD process (hereinafter referred to as "RF-PCVD") using the frequency in the RF band. The construction of the fabrication system shown in FIG. 4 is as follows.

This system is composed mainly of a deposition apparatus (4100), a supply apparatus of source gases (4200), and an evacuation apparatus (not illustrated) for reducing the pressure inside the reaction vessel (4111). Installed inside the reaction vessel (4111) in the deposition apparatus (4100) are a cylindrical substrate (4112), a heater (4113) for heating the substrate, and source gas inlet pipes (4114), and further, a high-frequency matching box (4115) is connected thereto.

The source gas supply apparatus (4200) is composed of bombs (4221 to 4226) of source gases of $SiH_4$, $GeH_4$, $H_2$, $CH_4$, $B_2H_6$, and $PH_3$, valves (4231 to 4236, 4241 to 4246, 4251 to 4256), and mass flow controllers (4211 to 4216), and the bomb of each source gas is connected through a valve (4260) to the gas inlet pipes (4114) inside the reaction vessel (4111).

Fabrication of a deposited film with this system can be carried out, for example, as follows.

First, the cylindrical substrate (4112) is set inside the reaction vessel (4111) and the inside of the reaction vessel is evacuated by the evacuation apparatus (for example, a vacuum pump) not illustrated. Subsequently, the temperature of the cylindrical substrate is controlled at the predetermined temperature in the range of 200° C. to 350° C. by the heater (4113) for heating the substrate.

For letting the source gases for fabrication of a deposited film flow into the reaction vessel (4111), it is first confirmed that the valves (4231 to 4236) of the source gas bombs and a leak valve (4117) of the reaction vessel are closed and that the gas inflow valves (4241 to 4246), the gas outflow valves (4251 to 4256), and the auxiliary valve (4260) are opened, and then the main valve (4118) is opened to evacuate the inside of the reaction vessel and gas pipes (4116).

Next, the auxiliary valve and gas outflow valves are closed when reading on a vacuum gage (4119) reaches approximately $1\times10^{-2}$ Pa.

After that, each gas is introduced from the source gas bomb with opening the valve (4231 to 4236) and the pressure of each gas is adjusted to 2 kg/cm$^2$ by a pressure regulator (4261 to 4266). Next, the gas inflow valve (4241 to 4246) is opened gradually to introduce each gas into the mass flow controller.

After completion of preparation for film formation as described above, each layer is made in the following procedures.

When the cylindrical substrate reaches the predetermined temperature, the auxiliary valve (4260) and necessary valves out of the gas outflow valves (4251 to 4256) are opened gradually to introduce predetermined gases from the source gas bombs through the gas inlet pipes into the reaction vessel. Then the flow rate of each source gas is adjusted to the predetermined flow rate by the mass flow controller.

On that occasion, opening of the main valve is adjusted as observing the vacuum gage so that the pressure inside the reaction vessel may be kept at the predetermined pressure of not more than $1.5\times10^2$ Pa. When the internal pressure becomes stable, RF power supply (not illustrated) of the frequency 13.56 MHz is set to desired power to introduce RF power through the high-frequency matching box into the reaction vessel, thereby producing glow discharge therein. This discharge energy decomposes the source gases introduced into the reaction vessel, whereby a deposited film containing the main ingredient of silicon as desired is made on the cylindrical substrate. After the deposited film is made in a desired film thickness, the supply of RF power is stopped, and the outflow valves are closed to stop the flow of gases into the reaction vessel, thus ending the fabrication of a deposited film.

By repeating the same operation a plurality of times, the light receiving layer is made in the desired multilayer structure.

It is a matter of course that all outflow valves except for gases necessary for making each layer are closed. In order to avoid the gases from remaining in the reaction vessel and in the pipes from the outflow valves to the reaction vessel, the operation for evacuating the inside of the system once to a high vacuum is carried out as occasion may demand, by closing the gas outflow valves, opening the auxiliary valve, and further fully opening the main valve.

To rotate the substrate at a predetermined speed by a driving device (not illustrated) is also effective during the fabrication of layer, for uniforming the fabrication of film.

Further, it is a matter of course that the gas species and valve operations described above should be changed according to the fabrication conditions of each layer.

The temperatures of the substrate during formation of a deposited film are preferably in the range of 200° C. to 350° C., more preferably in the range of 230° C. to 330° C., and most preferably in the range of 250° C. to 300° C.

The heating method of substrate may be carried out by any heat generator of vacuum specifications and, more specifically, the heat generator is selected from electrical resistance heat generators such as a coil heater of sheathed heater, a plate-shaped heater, or a ceramic heater; thermal radiation lamp heat generators such as a halogen lamp or an infrared lamp; heat generators by heat exchange means with a thermal medium of liquid, gas, or the like, and so on. A material for the surface of the heating means can be selected from metals such as stainless steel, nickel, aluminum, or copper, ceramics, heat-resistant polymer resins, and so on. In addition to the above, another applicable method is a method for preparing a vessel for dedicated use for heating separately from the reaction vessel, heating the substrate therein, and carrying the substrate therefrom into the reaction vessel with keeping it in a vacuum.

EXPERIMENT EXAMPLES

The effects of the present invention will be described specifically with experiment examples.

Experiment Example 1

Using the fabrication system of a light receiving member by the RF-PCVD process shown in FIG. 4, the light receiving member was made by forming the charge injection preventing layer, the photoconductive layer, and the surface layer under the conditions shown in Table 1 on a mirror-finished aluminum cylinder (substrate) of the diameter of 80 mm. On that occasion the photoconductive layer was formed in the order of the first layer region and the second layer region from the charge injection preventing layer side.

On the other hand, a cylindrical sample holder provided with grooves for installation of sample substrates was set in place of the aluminum cylinder and an a-Si film was deposited in the thickness of about 1 $\mu$m under the above mentioned forming conditions of the photoconductive layer on each of a glass substrate (Corning 7059) and an Si wafer. The optical band gap (Eg) was measured of the deposited film on the glass substrate and thereafter a comb electrode of Cr was evaporated thereon. Then the characteristic energy (Eu) of exponential tail was measured by CPM. For the deposited film on the Si wafer, the hydrogen content (Ch) was measured by FTIR. Since the films formed on the samples and the film formed directly or via another layer on the substrate for a light receiving member are formed under the same forming conditions, the films can be assumed to be formed with the same characteristics.

In the example of Table 1 Ch, Eg, and Eu of the first layer region were 35 atomic %, 1.86 eV, and 55 meV, respectively, and Ch, Eg, and Eu of the second layer region were 15 atomic %, 1.73 eV, and 53 meV, respectively.

Next, a variety of light receiving members with different Eg (Ch), Eu of the second layer region were made by variously changing the flow rate of $SiH_4$ gas, the mixture ratio of $SiH_4$ gas to $H_2$ gas, the ratio of the discharge power to the flow rate of $SiH_4$ gas, and the temperature of substrate in the second layer region. The thicknesses of the first layer region and second layer region were fixed at 20 μm and at 10 μm, respectively.

The light receiving members thus fabricated were set on an electrophotographic apparatus (which was a modified model for experiment from NP-6550 available from CANON INC.) and potential characteristics thereof were evaluated. On that occasion, a surface potential of each light receiving member was measured as the chargeability by a potential sensor of surface electrometer (Model 344 from TREK CO.) set at the position of developing device in the electrophotographic apparatus under the conditions of process speed 380 mm/sec, pre-exposure 4 lux·sec (LED of wavelength 700 nm), and current of charging device 1000 μA. The chargeability was measured at each temperature under the above conditions with changing temperatures from the room temperature (about 25° C.) to 45° C. by the drum heater set inside the light receiving member, and a rate of change of chargeability per ° C. at that time was taken as the temperature characteristic of chargeability. The E-V characteristic (curve) was measured at each of the room temperature and 45° C. while the charging conditions were set so as to attain the dark potential of 400 V and the LED of 680 nm was used as an image exposure light source. Then the temperature characteristic of sensitivity and the linearity of sensitivity were evaluated based on the E-V characteristics obtained. As for the optical memory, the LED of 680 nm was used as the image exposure light source as in the case of the sensitivity, the same potential sensor was used under the above-stated conditions to measure a potential difference between a surface potential in a non-exposure state and a surface potential at recharging after exposure, and a value of the potential difference was taken as a memory potential.

Relations of the chargeability, temperature characteristic of chargeability, optical memory, temperature characteristic of sensitivity, and linearity of sensitivity with Eg and Eu of the present example are shown in FIG. 5, FIG. 6, FIG. 7, FIG. 8, and FIG. 9, respectively. The characteristics are indicated by relative values with respect to 1 for an example wherein the photoconductive layer (30 μm thick) is made of only the first layer region. As apparent from FIG. 5, FIG. 6, FIG. 7, FIG. 8, and FIG. 9, it was confirmed that good characteristics were achieved as to each of the chargeability, temperature characteristic of chargeability, memory, temperature characteristic of sensitivity, and linearity of sensitivity under the conditions that in the second layer region Eg was not less than 1.7 eV and less than 1.8 eV and Eu was not more than 55 meV.

It was also proved that the same results were attained where the semiconductor laser (wavelength 680 nm) replaced the LED as an exposure light source.

TABLE 1

| Gas species/ conditions | Charge injection preventing layer | Photoconductive layer: first layer region | Photoconductive layer: second layer region | Surface layer |
|---|---|---|---|---|
| $SiH_4$ (SCCM) | 200 | 100 | 100 | 10 |
| $H_2$ (SCCM) | 500 | 1000 | 200 | — |
| $B_2H_6$ (ppm) (with respect to $SiH_4$) | 2000 | 0.5 | 0.5 | — |
| NO (SCCM) | 5 | — | — | — |
| $CH_4$ (SCCM) | — | — | — | 500 |
| Temperature of substrate (° C.) | 260 | 260 | 260 | 260 |
| Pressure (Pa) | 65 | 65 | 65 | 65 |
| RF power (W) | 300 | 500 | 75 | 200 |
| Thickness (μm) | 3 | 20 | 10 | 0.5 |

Experiment Example 2

Using the fabrication system of a light receiving member by the RF-PCVD process shown in FIG. 4, light receiving members were fabricated by forming the charge injection preventing layer, the photoconductive layer, and the surface layer on a mirror-finished aluminum cylinder (substrate) of the diameter of 80 mm under the same conditions as in Experiment Example 1, while the photoconductive layers of the respective light receiving members were made with changing the ratio (ratio of thickness) of the second layer region to the photoconductive layer.

Evaluation of potential characteristic was conducted in the same manner as in Experiment Example 1 for the individual light receiving members thus fabricated.

Figure 10:
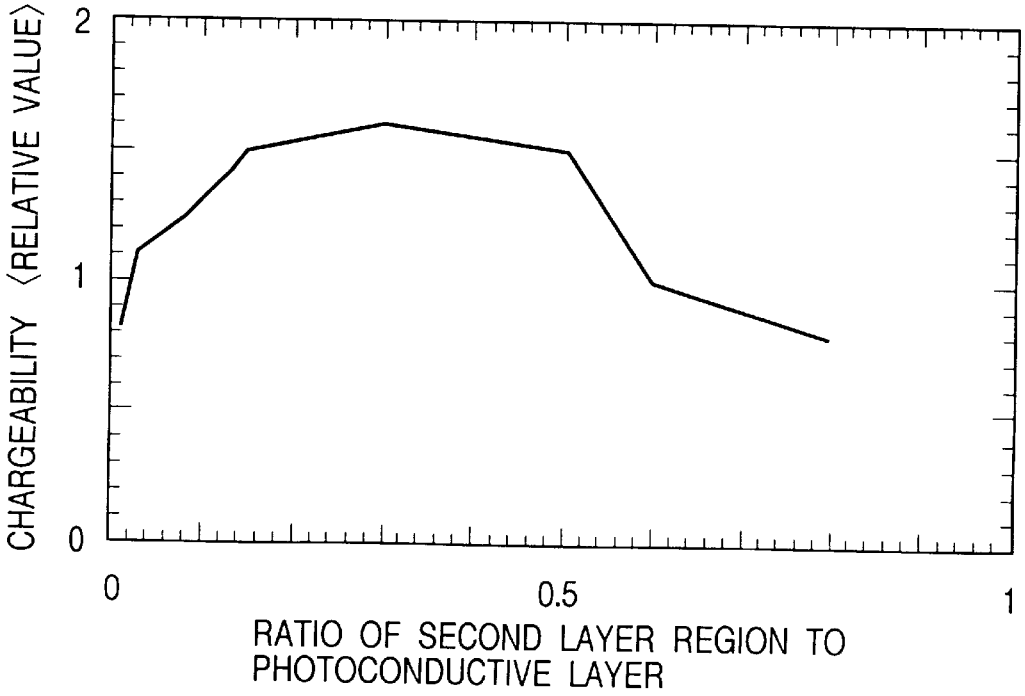
FIG. 10 is a view to show an example of relationship of chargeability to ratio of the second layer region in the photoconductive layer (ratio of thickness)
Figure 11:
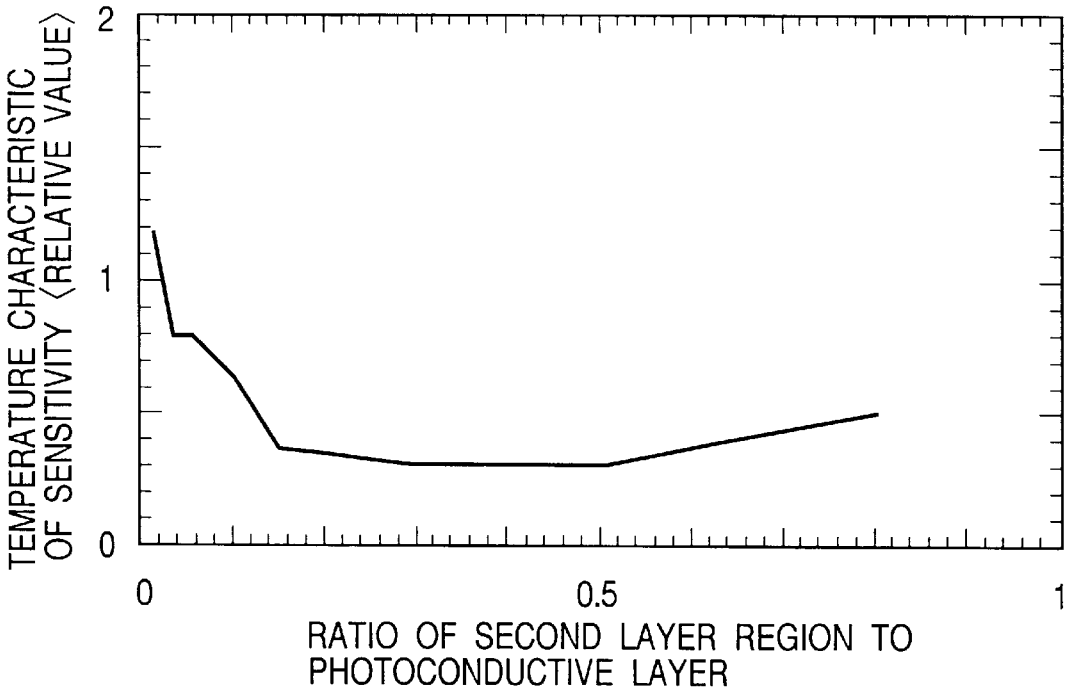
FIG. 11 is a view to show an example of relationship of temperature characteristic of sensitivity to ratio of the second layer region in the photoconductive layer (ratio of thickness)
Figure 12:
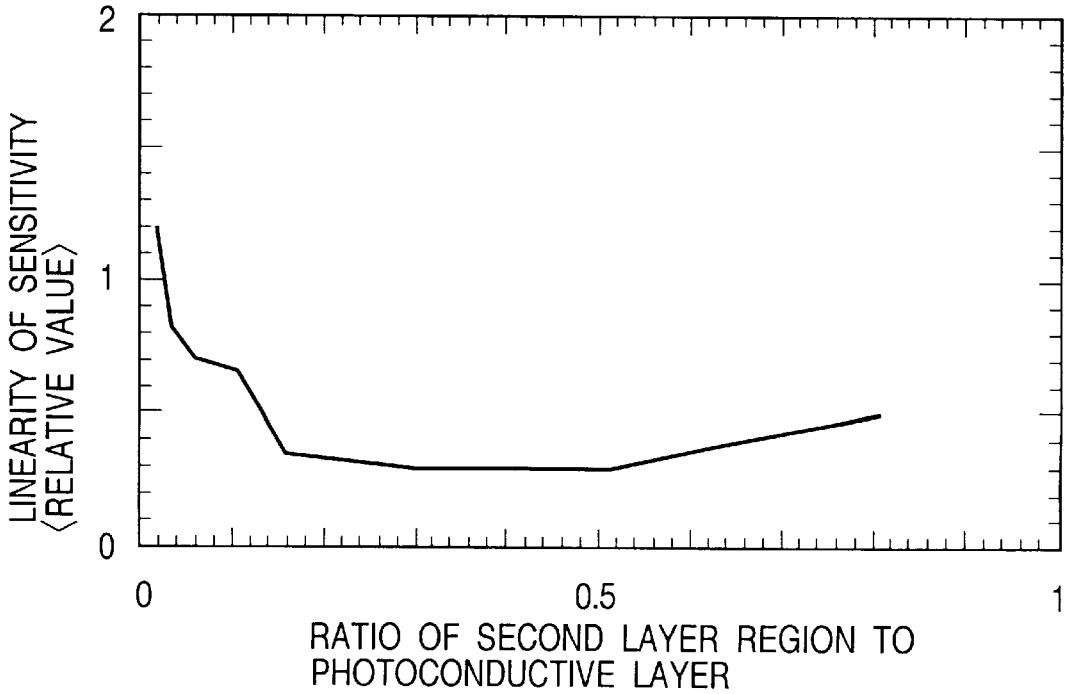
FIG. 12 is a view to show an example of relationship of linearity of sensitivity to ratio of the second layer region in the photoconductive layer (ratio of thickness)

Relations of the chargeability, temperature characteristic of sensitivity, and linearity of sensitivity with the ratio of the second layer region to the photoconductive layer of the present example are shown in FIG. 10, FIG. 11, and FIG. 12, respectively. The characteristics are indicated by relative values with respect to 1 for the example wherein the photoconductive layer (the total thickness of which is 30 μm) is made of only the first layer region. As apparent from FIG. 10, FIG. 11, and FIG. 12, it was confirmed that when the second layer region was provided on the surface side, good characteristics were achieved as to each of the chargeability, temperature characteristic of sensitivity, and linearity of sensitivity where the ratio of the thickness of the second layer region to the total thickness of the photoconductive layer (the ratio of the second layer region to the photoconductive layer) was in the range of 0.15 to 0.5.

Experiment Example 3

Using the fabrication system of a light receiving member by the RF-PCVD process shown in FIG. 4, light receiving members were fabricated by forming the charge injection preventing layer, the photoconductive layer, and the surface layer on the mirror-finished aluminum cylinder (substrate) of the diameter of 80 mm under the same conditions as in Experiment Example 1. On that occasion, reversing the stacking order of the first layer region and the second layer region, the photoconductive layer was formed in the order of the second layer region and the first layer region from the charge injection preventing layer side.

For the individual light receiving members thus fabricated, evaluation of potential characteristic thereof was carried out in the same manner as in Experiment Example 1 except that the pre-exposure light source was changed to the LED of the wavelength of 565 nm and the image exposure light source to a halogen lamp, and further, the density distribution, so called image coarseness, by solid black image was checked as image characteristics. As a consequence, it was proved that the chargeability and temperature characteristic of chargeability were improved and the level of image coarseness was also improved in comparison with the case wherein the photoconductive layer was made of only the first layer region, under the conditions that in the second layer region Eg was not less than 1.7 eV and less than 1.8 eV and that Eu was not more than 55 meV.

Experiment Example 4

Using the fabrication system of a light receiving member by the RF-PCVD process shown in FIG. 4, light receiving members were fabricated by forming the charge injection preventing layer, the photoconductive layer, and the surface layer on the mirror-finished aluminum cylinder (substrate) of the diameter of 80 mm under the same conditions as in Experiment Example 3. On that occasion, the photoconductive layers were formed with changing the ratio (ratio of thickness) of the second layer region to the photoconductive layer.

The same characteristic evaluation as in Experiment Example 3 was conducted for the individual light receiving members thus fabricated.

Figure 13:
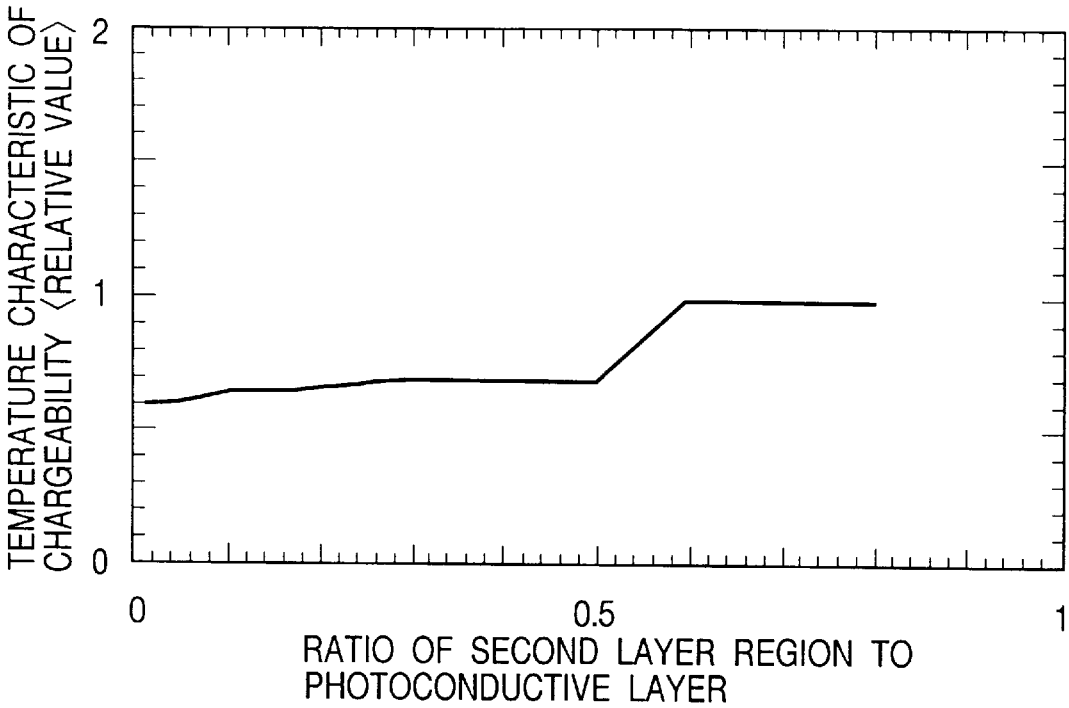
FIG. 13 is a view to show an example of relationship of temperature characteristic of chargeability to ratio of the second layer region in the photoconductive layer (ratio of thickness)
Figure 14:
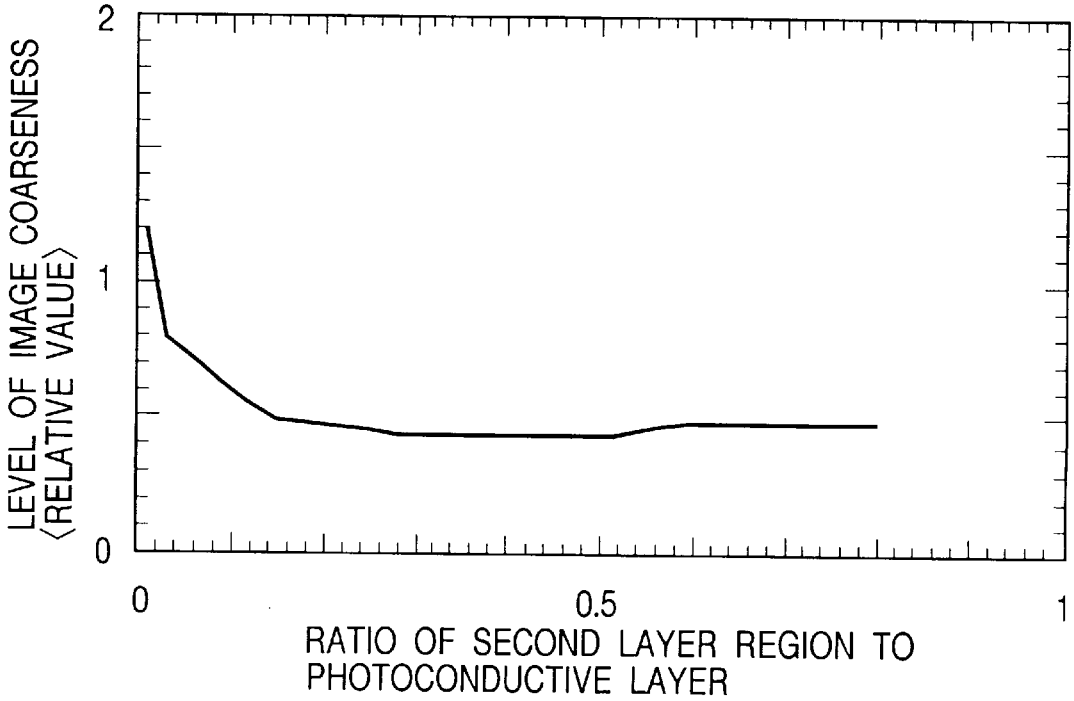
FIG. 14 is a view to show an example of relationship of density distribution (image coarseness) in solid black image to ratio of the second layer region in the photoconductive layer (ratio of thickness).

In the light receiving members of the present example, relations of the temperature characteristic of chargeability and level of image coarseness with the ratio of the second layer region to the photoconductive layer are shown in FIG. 13 and FIG. 14, respectively. The characteristics are indicated by relative values with respect to 1 for the case wherein the photoconductive layer (the total thickness of which is 30 $\mu$m) is made of only the first layer region. As apparent from FIG. 13 and FIG. 14, it was confirmed that when the second layer region was provided on the substrate side, the temperature characteristic of chargeability and the level of image coarseness were good under the condition that the ratio of the second layer region to the photoconductive layer was not less than 0.03 and not more than 0.5.

Further light receiving members were fabricated with decreasing the diameter of substrate to 60 mm and to 30 mm, with which no image defect due to peeling of film was recognized under the condition that the ratio of the second layer region to the photoconductive layer was not less than 0.03 and not more than 0.5.

Experiment Example 5

Using the fabrication system of a light receiving member by the RF-PCVD process shown in FIG. 4, light receiving members were fabricated by forming the charge injection preventing layer, the photoconductive layer, and the surface layer on the mirror-finished aluminum cylinder (substrate) of the diameter of 80 mm under the same conditions as in Experiment Example 1. On this occasion, the photoconductive layers were made by stacking the second layer region, the first layer region, and the second layer region in this order from the charge injection preventing layer side.

The same evaluation as in Experiment Example 1 was conducted for the individual light receiving members thus fabricated and the same image evaluation as in Experiment Example 3 was further carried out therefor.

Improvements of characteristics were recognized in all of the chargeability, temperature characteristic of chargeability, memory, temperature characteristic of sensitivity, linearity of sensitivity, and level of image coarseness under the conditions that in the second layer region Eg was not less than 1.7 eV and less than 1.8 eV and Eu was not more than 55 meV and that the ratio of the second layer region to the photoconductive layer was not less than 0.03 and not more than 0.5.

Examples

The present invention will be described in further detail with examples, but it is noted that the present invention is by no means intended to be limited to these examples.

Example 1

Using the fabrication system of a light receiving member by the RF-PCVD process shown in FIG. 4, the light receiving member was fabricated by forming the charge injection preventing layer, the photoconductive layer, and the surface layer on the mirror-finished aluminum cylinder (substrate) of the diameter of 80 mm. On that occasion, the photoconductive layer was made by forming the first layer region and the second layer region in this order from the charge injection preventing layer side. The fabrication conditions of a light receiving member are shown in Table 2.

In the light receiving member of the present example, Ch, Eg, and Eu of the first layer region in the photoconductive layer were 35 atomic %, 1.84 eV, and 55 meV, respectively, and Ch, Eg, and Eu of the second layer region were 20 atomic %, 1.75 eV, and 54 meV, respectively.

The light receiving member thus fabricated was set in the electrophotographic apparatus (which was the modified model for experiment from NP-6550 available from CANON INC. and in which image exposure was effected by the semiconductor laser of 680 nm and the LED of 680 nm) and evaluation of potential characteristic thereof was conducted. Good results were attained for all of the chargeability, temperature characteristic of chargeability, memory, temperature characteristic of sensitivity, and linearity of sensitivity.

The light receiving member fabricated was positively charged and image evaluation was conducted therefor. The optical memory was not observed on images, either, and good electrophotographic characteristics were also achieved for the other image characteristics (dots and image smearing).

Namely, it was found that when the photoconductive layer was made in the order of the first layer region and the second layer region from the charge injection preventing layer side, the necessary conditions for achieving good electrophotographic characteristics were such that Eu of the photoconductive layer was not more than 55 meV, that Ch and Eg in the first layer region were not less than 25 atomic % and less than 40 atomic % and not less than 1.8 eV and less than 1.9 eV, 5 respectively, and that Ch and Eg in the second layer region were not less than 10 atomic % and less than 25 atomic % and not less than 1.7 eV and less than 1.8 eV, respectively.

TABLE 2

| Gas species/ conditions | Charge injection preventing layer | Photoconductive layer first layer region | Photoconductive layer second layer region | Surface layer |
|---|---|---|---|---|
| $SiH_4$ (SCCM) | 150 | 100 | 150 | 10 |
| $H_2$ (SCCM) | 600 | 800 | 800 | — |
| $B_2H_6$ (ppm) (with respect to $SiH_4$) | 2000 | 0.5 | 0.5 | — |
| NO (SCCM) | 5 | — | — | — |
| $CH_4$ (SCCM) | — | — | — | 500 |
| Temperature of substrate (° C.) | 260 | 260 | 260 | 260 |
| Pressure (Pa) | 55 | 65 | 65 | 40 |
| RF power (W) | 200 | 500 | 200 | 200 |
| Thickness (μm) | 3 | 20 | 10 | 0.5 |

Example 2

In the present example, by use of the mirror-finished aluminum cylinder (substrate) of the diameter of 80 mm, the light receiving member was fabricated in such a manner that the photoconductive layer was made by forming the first layer region and the second layer region in this order from the charge injection preventing layer side and that the surface layer of Example 1 was replaced by a surface layer in which distribution of contents of silicon atoms and carbon atoms of the surface layer was nonuniform in the direction of thickness. The fabrication conditions of a light receiving member are shown in Table 3.

The light receiving member thus fabricated was set in the electrophotographic apparatus (which was the modified model for experiment from NP-6550 available from CANON INC. and in which image exposure was effected by the semiconductor laser of 680 nm and the LED of 680 nm) and the same evaluation as in Example 1 was conducted. Then good electrophotographic characteristics were achieved as in Example 1.

Namely, it was found that when the photoconductive layer was made in the order of the first layer region and the second layer region from the charge injection preventing layer side and when the surface layer was made in such a manner that the distribution of contents of silicon atoms and carbon atoms of the surface layer was nonuniform in the direction of thickness, the necessary conditions for obtaining good electrophotographic characteristics were such that Eu of the photoconductive layer was not more than 55 meV, that Ch and Eg in the first layer region were not less than 25 atomic % and less than 40 atomic % and not less than 1.8 eV and less than 1.9 eV, respectively, and that Ch and Eg in the second layer region were not less than 10 atomic % and less than 25 atomic % and not less than 1.7 eV and less than 1.8 eV, respectively.

In the following tables, the arrows connecting two flow rate values show that the flow rate is changed from the left value to the right value with the elapse of time.

TABLE 3

| Gas species/ conditions | Charge injection preventing layer | Photoconductive layer first layer region | Photoconductive layer second layer region | Surface layer |
|---|---|---|---|---|
| $SiH_4$ (SCCM) | 300 | 75 | 100 | 200 → 20 → 20 |
| $H_2$ (SCCM) | 300 | 1000 | 600 | — |
| $B_2H_6$ (ppm) (with respect to $SiH_4$) | 2000 | 0.5 | 0.5 | — |
| NO (SCCM) | 5 | — | — | — |
| $CH_4$ (SCCM) | — | — | — | 50 → 600 → 600 |
| Temperature of substrate (° C.) | 260 | 260 | 290 | 280 |
| Pressure (Pa) | 55 | 65 | 65 | 65 |
| RF power (W) | 300 | 500 | 100 | 150 |
| Thickness (μm) | 3 | 25 | 5 | 0.5 |

Example 3

In the present example, the mirror-finished aluminum cylinder (substrate) of the diameter of 80 mm was used, the photoconductive layer was made by forming the first layer region and the second layer region in this order from the charge injection preventing layer side, He was used in place of $H_2$ in Example 1, and the surface layer of Example 1 was replaced by the surface layer in which the distribution of contents of silicon atoms and carbon atoms of the surface layer was nonuniform in the direction of thickness. The fabrication conditions of a light receiving member are shown in Table 4.

The light receiving member thus fabricated was set in the electrophotographic apparatus (which was the modified model for experiment from NP-6550 available from CANON INC. and in which image exposure was effected by the semiconductor laser of 680 nm and the LED of 680 nm) and the same evaluation as in Example 1 was conducted. Then good electrophotographic characteristics were achieved as in Example 1.

Namely, it was found that when He was used instead of $H_2$, when the photoconductive layer was made in the order of the first layer region and the second layer region from the charge injection preventing layer side, and when the surface layer was made in such a manner that the distribution of contents of silicon atoms and carbon atoms of the surface layer was nonuniform in the direction of thickness, the necessary conditions for obtaining good electrophotographic characteristics were such that Eu of the photoconductive layer was not more than 55 meV, that Ch and Eg in the first layer region were not less than 25 atomic % and less than 40 atomic % and not less than 1.8 eV and less than 1.9 eV, respectively, and that Ch and Eg in the second layer region were not less than 10 atomic % and less than 25 atomic % and not less than 1.7 eV and less than 1.8 eV, respectively.

TABLE 4

| Gas species/ conditions | Charge injection preventing layer | Photoconductive layer first layer region | Photoconductive layer second layer region | Surface layer |
|---|---|---|---|---|
| $SiH_4$ (SCCM) | 300 | 150 | 100 | 200 → 20 → 20 |
| He (SCCM) | 300 | 1500 | 600 | — |
| $B_2H_6$ (ppm) (with respect to $SiH_4$) | 2000 | 0.5 | 0.5 | — |
| NO (SCCM) | 5 | — | — | — |
| $CH_4$ (SCCM) | — | — | — | 50 → 600 → 600 |
| Temperature of substrate (° C.) | 260 | 260 | 290 | 280 |
| Pressure (Pa) | 55 | 65 | 65 | 25 |
| RF power (W) | 300 | 800 | 100 | 150 |
| Thickness (μm) | 3 | 15 | 15 | 0.5 |

Example 4

In the present example, the mirror-finished aluminum cylinder (substrate) of the diameter of 80 mm was used, the photoconductive layer was made by forming the first layer region and the second layer region in this order from the charge injection preventing layer side, the surface layer of Example 1 was replaced by the surface layer in which the distribution of contents of silicon atoms and carbon atoms of the surface layer was nonuniform in the direction of thickness, and all the layers contained fluorine atoms, boron atoms, carbon atoms, oxygen atoms, and nitrogen atoms. The fabrication conditions of a light receiving member are shown in Table 5.

The light receiving member thus fabricated was set in the electrophotographic apparatus (which was the modified model for experiment from NP-6550 available from CANON INC. and in which image exposure was effected by the semiconductor laser of 680 nm and the LED of 680 nm) and the same evaluation as in Example 1 was conducted. Then good electrophotographic characteristics were achieved as in Example 1.

Namely, it was found that when the photoconductive layer was made in the order of the first layer region and the second layer region from the charge injection preventing layer side, when the surface layer was made in such a manner that the distribution of contents of silicon atoms and carbon atoms of the surface layer was nonuniform in the direction of thickness, and when the all layers contained the fluorine atoms, boron atoms, carbon atoms, oxygen atoms, and nitrogen atoms, the necessary conditions for obtaining good electrophotographic characteristics were such that Eu of the photoconductive layer was not more than 55 meV, that Ch and Eg in the first layer region were not less than 25 atomic % and less than 40 atomic % and not less than 1.8 eV and less than 1.9 eV, respectively, and that Ch and Eg in the second layer region were not less than 10 atomic % and less than 25 atomic % and not less than 1.7 eV and less than 1.8 eV, respectively.

TABLE 5

| Gas species/ conditions | Charge injection preventing layer | Photoconductive layer first layer region | Photoconductive layer second layer region | Surface layer |
|---|---|---|---|---|
| $SiH_4$ (SCCM) | 200 | 100 | 100 | 10 |
| $H_2$ (SCCM) | 500 | 1000 | 200 | — |
| $B_2H_6$ (ppm) (with respect to $SiH_4$) | 2000 | 0.5 | 0.5 | — |
| NO (SCCM) | 5 | — | — | — |
| $CH_4$ (SCCM) | — | — | — | 500 |
| Temperature of substrate (° C.) | 260 | 260 | 260 | 260 |
| Pressure (Pa) | 65 | 65 | 65 | 65 |
| RF power (W) | 300 | 500 | 75 | 200 |
| Thickness (μm) | 3 | 20 | 10 | 0.5 |

Example 5

In the present example, the mirror-finished aluminum cylinder (substrate) of the diameter of 80 mm was used, the photoconductive layer was made by forming the second layer region and the first layer region in this order from the charge injection preventing layer side, and the surface layer of Example 1 was replaced by the surface layer in which the distribution of contents of silicon atoms and carbon atoms of the surface layer was nonuniform in the direction of thickness. The fabrication conditions of a light receiving member are shown in Table 6.

The light receiving member thus fabricated was set in the electrophotographic apparatus (which was the modified model for experiment from NP-6550 available from CANON INC. and in which image exposure was effected by a halogen lamp) and evaluation of potential characteristic was conducted. Good results were obtained as to all of the chargeability, temperature characteristic of chargeability, and memory.

The light receiving member thus fabricated was positively charged and image evaluation was conducted. Then the optical memory was not observed on images, either, and good results were obtained for the other image characteristics (dots and image smearing). Especially, the image coarseness was of a very good level.

Namely, it was found that when the photoconductive layer was made in the order of the second layer region and the first layer region from the charge injection preventing layer side and when the surface layer was made in such a manner that the distribution of contents of silicon atoms and carbon atoms of the surface layer was nonuniform in the direction of thickness, the necessary conditions for obtaining good electrophotographic characteristics were such that Eu of the photoconductive layer was not more than 55 meV, that Ch and Eg in the first layer region were not less than 25 atomic % and less than 40 atomic % and not less than 1.8 eV and less than 1.9 eV, respectively, and that Ch and Eg in the second layer region were not less than 10 atomic % and less than 25 atomic % and not less than 1.7 eV and less than 1.8 eV, respectively.

TABLE 6

| Gas species/ conditions | Charge injection preventing layer | Photoconductive layer second layer region | Photoconductive layer first layer region | Surface layer |
|---|---|---|---|---|
| $SiH_4$ (SCCM) | 200 | 200 | 100 | 200 → 10 → 10 |
| $H_2$ (SCCM) | 500 | 1000 | 1000 | — |
| $B_2H_6$ (ppm) (with respect to $SiH_4$) | 3000 | 0.5 | 0.5 | 0.5 |
| NO (SCCM) | 10 | — | — | — |
| $CH_4$ (SCCM) | — | — | — | 50 → 600 → 700 |
| Temperature of substrate (° C.) | 270 | 260 | 260 | 250 |
| Pressure (Pa) | 40 | 55 | 55 | 50 |
| RF power (W) | 300 | 200 | 600 | 100 |
| Thickness (μm) | 3 | 5 | 25 | 0.6 |

Example 6

In the present example, a mirror-finished aluminum cylinder (substrate) of the diameter of 30 mm was used instead of the substrate used in Examples 1 to 5, the photoconductive layer was made by forming the second layer region and the first layer region in this order from the charge injection preventing layer side, and an intermediate layer (an upper preventing layer) containing atoms for controlling the conductive property and having a smaller content of carbon atoms than the surface layer was provided between the photoconductive layer and the surface layer. The fabrication conditions of a light receiving member are shown in Table 7.

The light receiving member thus fabricated was set in the electrophotographic apparatus (which was a modified model for experiment from NP-6030 available from CANON INC. and in which image exposure was effected by a halogen lamp) and the same evaluation as in Example 5 was conducted. Good results were obtained as to all of the chargeability, temperature characteristic of chargeability, and memory.

The light receiving member thus fabricated was negatively charged and image evaluation was conducted. Then the optical memory was not observed on images, either, and good results were obtained for the other image characteristics (dots and image smearing). Especially, the image coarseness was of a very good level.

Namely, it was found that when the mirror-finished aluminum cylinder (substrate) of the diameter of 30 mm was used, when the photoconductive layer was made in the order of the second layer region and the first layer region from the charge injection preventing layer side, and when the intermediate layer (upper preventing layer) having the smaller content of carbon atoms than the surface layer and containing the atoms for controlling the conductive property was provided between the photoconductive layer and the surface layer, the necessary conditions for obtaining good electrophotographic characteristics were such that Eu of the photoconductive layer was not more than 55 meV, that Ch and Eg in the first layer region were not less than 25 atomic % and less than 40 atomic % and not less than 1.8 eV and less than 1.9 eV, respectively, and that Ch and Eg in the second layer region were not less than 10 atomic % and less than 25 atomic % and not less than 1.7 eV and less than 1.8 eV, respectively.

TABLE 7

| Gas species/ conditions | Charge injection preventing layer | Photoconductive layer second layer region | Photoconductive layer first layer region | Intermediate layer | Surface layer |
|---|---|---|---|---|---|
| $SiH_4$ (SCCM) | 200 | 200 | 100 | 50 | 10 |
| $H_2$ (SCCM) | 500 | 1000 | 1000 | — | — |
| $B_2H_6$ (ppm) (with respect to $SiH_4$) | — | 0.5 | 0.5 | 1000 | — |
| $PH_3$ (ppm) (with respect to $SiH_4$) | 3000 | — | — | — | — |
| NO (SCCM) | 10 | — | — | — | — |

TABLE 7-continued

| Gas species/ conditions | Charge injection preventing layer | Photoconductive layer second layer region | first layer region | Intermediate layer | Surface layer |
|---|---|---|---|---|---|
| $CH_4$ (SCCM) | — | — | — | 300 | 600 |
| Temperature of substrate (° C.) | 270 | 260 | 260 | 260 | 250 |
| Pressure (Pa) | 40 | 55 | 55 | 55 | 60 |
| RF power (W) | 300 | 200 | 600 | 200 | 150 |
| Thickness (μm) | 3 | 5 | 25 | 0.1 | 0.3 |

Example 7

In the present example, the mirror-finished aluminum cylinder (substrate) of the diameter of 30 mm was used, the photoconductive layer was made by forming the second layer region, the first layer region, and the second layer region in this order from the charge injection preventing layer side, and the surface layer was made in such a manner that the distribution of contents of silicon atoms and carbon atoms was nonuniform in the direction of thickness. The fabrication conditions of a light receiving member are shown in Table 8.

The light receiving member thus fabricated was set in the electrophotographic apparatus (the modified model for experiment from NP-6030 available from CANON INC.) and evaluation of potential characteristic was conducted using the halogen lamp, the LED (wavelength 680 nm), and the laser (wavelength 680 nm) for image exposure. Good results were achieved for all of the chargeability, temperature characteritic of chargeability, memory, temperature characteristic of sensitivity, and linearity of sensitivity.

The light receiving member thus fabricated was positively charged and image evaluation was conducted. Then the optical memory was not observed on images, either, and good results were obtained for the other image characteristics (dots and image smearing). Especially, the image coarseness was of a very good level.

Namely, it was found that when the photoconductive layer was made in the order of the second layer region, the first layer region, and the second layer region from the charge injection preventing layer side and when the surface layer was made in such a manner that the distribution of contents of silicon atoms and carbon atoms was nonuniform in the direction of thickness, the necessary conditions for obtaining good electrophotographic characteristics were such that Eu of the photoconductive layer was not more than 55 meV, that Ch and Eg in the first layer region were not less than 25 atomic % and less than 40 atomic % and not less than 1.8 eV and less than 1.9 eV, respectively, and that Ch and Eg in the second layer region were not less than 10 atomic % and less than 25 atomic % and not less than 1.7 eV and less than 1.8 eV, respectively.

TABLE 8

| Gas species/ conditions | Charge injection preventing layer | Photoconductive layer second layer region | first layer region | second layer region | Surface layer |
|---|---|---|---|---|---|
| $SiH_4$ (SCCM) | 200 | 75 | 100 | 75 | 200 → 10 |
| $H_2$ (SCCM) | 600 | 500 | 1200 | 500 | — |
| $B_2H_6$ (ppm) (with respect to $SiH_4$) | 1500 | 1 | 1 | 0.5 | — |
| NO (SCCM) | 10 | — | — | — | — |
| $CH_4$ (SCCM) | — | — | — | — | 10 → 600 |
| Temperature of substrate (° C.) | 300 | 300 | 300 | 300 | 300 |
| Pressure (Pa) | 55 | 65 | 65 | 65 | 55 |
| RF power (W) | 200 | 150 | 700 | 150 | 150 |
| Thickness (μm) | 3 | 2 | 20 | 10 | 0.5 |

Example 8

In the present example, Example 1 was modified in such a way that He was used in addition to $H_2$ and that, as atoms constituting the surface layer, nitrogen atoms replaced the carbon atoms in the surface layer. The fabrication conditions of a light receiving member are shown in Table 9.

The light receiving member thus fabricated was subjected to the same evaluation as in Example 1 and good electrophotographic characteristics were achieved similarly.

Namely, it was found that when the photoconductive layer was made in the order of the first layer region and the second layer region from the charge injection preventing layer side as using He in addition to $H_2$ and when the surface layer was made to contain nitrogen atoms, in place of carbon atoms, as the atoms constituting the surface layer, the necessary conditions for obtaining good electrophotographic characteristics were such that Eu of the photoconductive layer was not more than 55 meV, that Ch and Eg in the first layer region were not less than 25 atomic % and less than 40 atomic % and not less than 1.8 eV and less than 1.9 eV, respectively, and that Ch and Eg in the second layer region were not less than 10 atomic % and less than 25 atomic % and not less than 1.7 eV and less than 1.8 eV, respectively.

TABLE 9

| Gas species/ conditions | Charge injection preventing layer | Photoconductive layer first layer region | second layer region | Surface layer |
|---|---|---|---|---|
| $SiH_4$ (SCCM) | 300 | 150 | 150 | 20 |
| $H_2$ (SCCM) | 300 | 1000 | 500 | — |
| He (SCCM) | 300 | 1000 | 500 | — |
| $B_2H_6$ (ppm) | 3000 | 0.5 | 0.5 | — |

TABLE 9-continued

| Gas species/ conditions | Charge injection preventing layer | Photoconductive layer first layer region | second layer region | Surface layer |
|---|---|---|---|---|
| (with respect to $SiH_4$) | | | | |
| NO (SCCM) | 5 | — | — | — |
| $NH_3$ (SCCM) | — | — | — | 200 |
| Temperature of substrate (° C.) | 290 | 280 | 260 | 250 |
| Pressure (Pa) | 50 | 60 | 60 | 30 |
| RF power (W) | 150 | 900 | 300 | 200 |
| Thickness (μm) | 3 | 20 | 10 | 0.3 |

EFFECTS OF THE INVENTION

The present invention can achieve the breakthrough improvements in the chargeability and the temperature characteristic of sensitivity in the operating temperature region of light receiving member and can substantially eliminate occurrence of optical memory, whereby stability is enhanced under the operating circumstances of light receiving member and whereby high-quality images can be obtained stably with high resolution and clear halftones.

Therefore, when the light receiving member for electrophotography according to the present invention is made in the specific structure as described above, the various problems in the conventional light receiving members for electrophotography comprised of a-Si can be solved and particularly, the light receiving member of the present invention demonstrates the extremely excellent, electrical, optical, and photoconductive characteristics, image characteristics, durability, and operating circumstance characteristics.

According to the present invention, when the photoconductive layer is composed of the layer regions of different optical band gaps and when the layer region with smaller optical band gap is provided on the surface side, the change of sensitivity is suppressed against variation in ambient circumstances in use of the semiconductor laser or the LED as an exposure light source, thereby achieving the extremely excellent potential characteristics and image characteristics.

In addition, when the photoconductive layer is made of the layer regions of different optical band gaps and when the layer region of smaller optical band gap is provided on the substrate side, the light receiving member has the extremely excellent potential characteristics and image characteristics with suppressing generation of small nonuniformity of image density and application to small-diameter substrates becomes easier.

It is a matter of course that the present invention is not limited to the above examples and the drawings, but it also involves appropriate modifications and combinations within the scope of the essence of the invention.

What is claimed is:

1. A light receiving member for electrophotography comprising a substrate at least a surface of which is electrically conductive, and a photoconductive layer formed of a non-monocrystal material containing at least either hydrogen atoms or halogen atoms in the matrix of silicon atoms, wherein said photoconductive layer has a first layer region, said first layer region being formed as a film in which characteristic energy (Eu) obtained from a linear portion (an exponential tail) of a function expressed by Equation (I) defined below with photon energy (hν) as an independent variable and absorption coefficient (α) of photoabsorption spectrum as a dependent variable:

$$ln\alpha=(1/Eu)\cdot h\nu+\alpha_1 \quad \text{(I)}$$

is not more than 55 meV, in which a content (Ch) of hydrogen atoms and/or halogen atoms is not less than 25 atomic % and less than 40 atomic %, and in which an optical band gap (Eg) is not less than 1.8 eV and less than 1.9 eV, and a second layer region, said second layer region being formed as a film in which Eu is not more than 55 meV, Ch is not less than 10 atomic % and less than 25 atomic %, and Eg is not less than 1.7 eV and less than 1.8 eV, and wherein a ratio of a thickness of the second layer region to a total thickness of said photoconductive layer is 0.03–0.5.

2. The light receiving member for electrophotography according to claim 1, wherein the second layer region is provided on the first layer region.

3. The light receiving member for electrophotography according to claim 1, wherein the first layer region is provided on the second layer region.

4. The light receiving member for electrophotography according to claim 1, wherein the first layer region is provided on the second layer region and another second layer region is provided on the first layer region.

5. The light receiving member for electrophotography according to claim 1, wherein said photoconductive layer contains at least one of the elements belonging to Group IIIb or Group Vb in the periodic table.

6. The light receiving member for electrophotography according to claim 1, wherein said photoconductive layer contains at least one of carbon, oxygen, and nitrogen.

7. The light receiving member for electrophotography according to claim 1, further comprising a surface layer comprising a non-monocrystal material containing at least one of carbon, oxygen, and nitrogen in the matrix of silicon atoms provided on the photoconductive layer.

8. The light receiving member for electrophotography according to claim 1, wherein the photoconductive layer is provided on a charge injection preventing layer comprising a non-monocrystal material containing at least one of carbon, oxygen, and nitrogen and at least one of the elements belonging to Group IIIb or Group Vb in the periodic table in the matrix of silicon atoms and wherein a surface layer comprising a non-monocrystal material containing at least one of carbon, oxygen, and nitrogen in the matrix of silicon atoms is provided on the photoconductive layer.

9. The light receiving member for electrophotography according to claim 8, wherein the thickness of the charge injection preventing layer is 0.1–5 μm.

10. The light receiving member for electrophotography according to claim 7, wherein the thickness of the surface layer is 0.01–3 μm.

11. The light receiving member for electrophotography according to claim 1, wherein the thickness of the photoconductive layer is 20–50 μm.

12. A process for fabricating a light receiving member for electrophotography in which a photoconductive layer is provided on a substrate at least having an electrically conductive surface, said process comprising:

a step of forming a first layer region of the photoconductive layer under such conditions that characteristic energy (Eu) obtained from a linear portion (an exponential tail) of a function expressed by Equation (I) defined below with photon energy (hν) as an independent variable and absorption coefficient (α) of photoabsorption spectrum as a dependent variable:

$$ln\alpha=(1/Eu)\cdot h\nu+\alpha_1 \quad \text{(I)}$$

is not more than 55 meV, a content (Ch) of hydrogen atoms and/or halogen atoms is not less than 25 atomic % and less than 40 atomic %, and an optical band gap (Eg) is not less than 1.8 eV and less than 1.9 eV; and a step of forming a second layer region of the photoconductive layer under such conditions that Eu is not more than 55 meV, Ch is not less than 10 atomic % and less than 25 atomic %, and Eg is not less than 1.7 eV and less than 1.8 eV.

13. The process according to claim 12, wherein said step of forming the second layer region is adjusted so that the ratio of the thickness of the second layer region to the total thickness of the photoconductive layer is 0.03–0.5.

14. The process according to claim 12, wherein said step of forming the first layer region is carried out before said step of forming the second layer region.

15. The process according to claim 12, wherein said step of forming the second layer region is carried out before said step of forming the first layer region.

16. The process according to claim 12, further comprising a step of forming a surface layer after completion of said step of forming the first layer region and said step of forming the second layer region.

17. The process according to claim 12, further comprising a step of forming a charge injection preventing layer before execution of said step of forming the first layer region and said step of forming the second layer region.

* * * * *

UNITED STATES PATENT AND TRADEMARK OFFICE

CERTIFICATE OF CORRECTION

PATENT NO. : 5,945,241

DATED : August 31, 1999

INVENTOR(S) : HIROAKI NIINO ET AL.

It is certified that error appears in the above-identified patent and that said Letters Patent is hereby corrected as shown below:

SHEET 6

Figure 8:
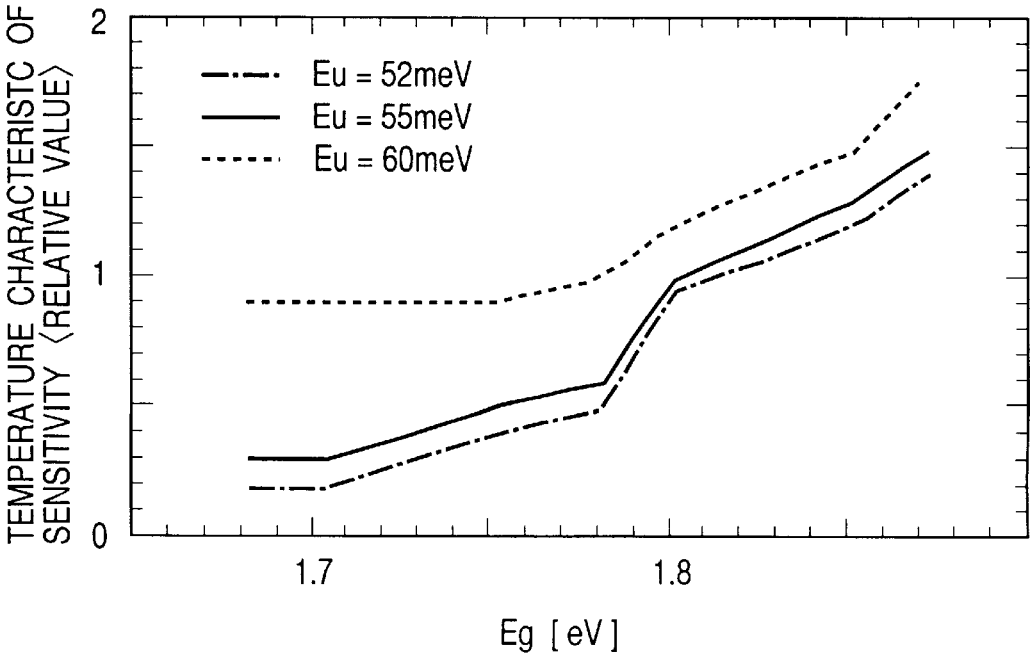
FIG. 8 is a view to show an example of relationship of temperature characteristic of sensitivity to optical band gap (Eg) of the second layer region in the photoconductive layer and to characteristic energy (Eu) of the Urback tail.
Figure 9:
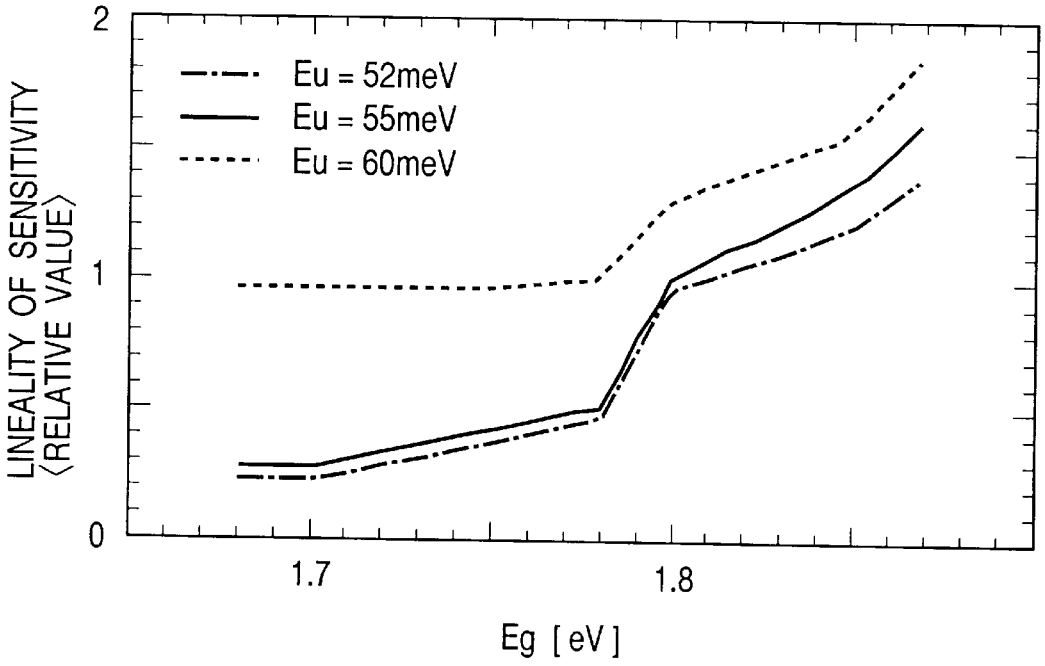
FIG. 9 is a view to show an example of relationship of linearity of sensitivity to optical band gap (Eg) of the second layer region in the photoconductive layer and to characteristic energy (Eu) of the Urback tail.

Figure 8, "CHARACTERISTC" should read --CHARACTERISTIC--.

COLUMN 1

Line 27, "harmlessness" should read --safety--.

COLUMN 3

Line 19, "described" should read --described in--.

COLUMN 4

Line 54, "wherein" should read --¶wherein--.

COLUMN 5

Line 35, "one sub" should read --the sub--;
Lien 53, "the the second" should read --the second--;
Line 55, of Urback" should read --of the Urback--.

COLUMN 7

Line 34, "constant). Thus, should read (constant). ¶Thus--;
Line 37, "valance" should read --valence--.

COLUMN 12

Line 10, "3C). The" should read --3C). ¶The--.

UNITED STATES PATENT AND TRADEMARK OFFICE

CERTIFICATE OF CORRECTION

PATENT NO. : 5,945,241

DATED : August 31, 1999

INVENTOR(S) : HIROAKI NIINO ET AL.

It is certified that error appears in the above-identified patent and that said Letters Patent is hereby corrected as shown below:

COLUMN 15

Line 10, "substance" should read --substances--;
Line 11, "substance" should read --substances--;
Line 12, "is" should read --are--;
Line 15, "substance" should read --substances--;
Line 21, "substance" should read --substances--;
Line 29, "raw-materials" should read --raw-material--.

COLUMN 16

Line 2, "demonstrating" should read --demonstrate--.

COLUMN 25

Line 25, "gage" should read --gauage--;
Line 29, "with" should read --by--;
Line 45, "¶On" should read --On--;
Line 46, "gage" should read --guage--.

COLUMN 26

Line 1, "avoid" should read --prevent--;
Line 35, "with" should read --by--.

COLUMN 30

Line 13, "therefor." should read --therefor, improvements--;
Line 14, "¶" should be deleted; and "Improvements" should be deleted.

COLUMN 34

Line 2, "the all" should read --all the--;
Table 5, delete entire table substitute:

UNITED STATES PATENT AND TRADEMARK OFFICE

CERTIFICATE OF CORRECTION

PATENT NO. : 5,945,241

DATED : August 31, 1999

INVENTOR(S) : HIROAKI NIINO ET AL.

It is certified that error appears in the above-identified patent and that said Letters Patent is hereby corrected as shown below:

| Gas species / conditions | Charge injection preventing layer | Photoconductive layer | | Surface layer |
|---|---|---|---|---|
| | | first laser region | second layer region | |
| $SiH_4$ (SCCM) | 300 | 150 | 200 | 200 → 10 → 10 |
| $SiF_4$ (SCCM) | 5 | 2 | 1 | 5 |
| $H_2$ (SCCM) | 500 | 2000 | 800 | - |
| $B_2H_6$ (ppm) (with respect to $SiH_4$) | 1500 | 0.7 | 0.5 | 1 |
| NO (SCCM) | 10 | 0.2 | 0.1 | 0.5 |
| $CH_4$ (SCCM) | 5 | 0.5 | 0.2 | 50 → 600 → 700 |
| Temperature of substrate (°C) | 270 | 260 | 260 | 250 |
| Pressure (Pa) | 40 | 55 | 55 | 55 |
| RF power (W) | 400 | 800 | 150 | 100 |
| Thickness (μm) | 3 | 20 | 10 | 0.6 |

COLUMN 37

Line 65, "characteritic" should read --characteristic--.

COLUMN 40

Line 63, "excellent," should read --excellent--.

UNITED STATES PATENT AND TRADEMARK OFFICE

CERTIFICATE OF CORRECTION

PATENT NO. : 5,945,241

DATED : August 31, 1999

INVENTOR(S) : HIROAKI NIINO ET AL.

It is certified that error appears in the above-identified patent and that said Letters Patent is hereby corrected as shown below:

COLUMN 41

Line 24, "wherein" should read --¶wherein--.

Signed and Sealed this

Twenty-seventh Day of June, 2000

*Attest:*

*Attesting Officer*

Q. TODD DICKINSON

*Director of Patents and Trademarks*